US008803423B2

(12) United States Patent
Sagawa et al.

(10) Patent No.: US 8,803,423 B2
(45) Date of Patent: Aug. 12, 2014

(54) FLUORESCENT LAMP AND IMAGE DISPLAY APPARATUS

(75) Inventors: Masakazu Sagawa, Inagi (JP); Shin Imamura, Kokubunji (JP); Toshiaki Kusunoki, Tokorozawa (JP)

(73) Assignee: Hitachi, Ltd., Tokyo (JP)

( * ) Notice: Subject to any disclaimer, the term of this patent is extended or adjusted under 35 U.S.C. 154(b) by 182 days.

(21) Appl. No.: 13/500,312

(22) PCT Filed: Feb. 23, 2010

(86) PCT No.: PCT/JP2010/052776

§ 371 (c)(1),
(2), (4) Date: Apr. 5, 2012

(87) PCT Pub. No.: WO2011/043088

PCT Pub. Date: Apr. 14, 2011

(65) Prior Publication Data

US 2012/0200613 A1 Aug. 9, 2012

(30) Foreign Application Priority Data

Oct. 8, 2009 (JP) ..... 2009-233980

(51) Int. Cl.
*H01J 17/00* (2006.01)

(52) U.S. Cl.
CPC ..... *H01J 17/00* (2013.01)
USPC ..... 313/586; 313/581

(58) Field of Classification Search
CPC ..... H01J 17/00
USPC ..... 313/581–586
See application file for complete search history.

(56) References Cited

U.S. PATENT DOCUMENTS 6,184,848 B1 2/2001 Weber
6,509,701 B1 1/2003 Rakhimov et al.

(Continued)

FOREIGN PATENT DOCUMENTS

EP 1 758 144 2/2007
JP 2001006565 1/2001

(Continued)

OTHER PUBLICATIONS

Ichihara, et al., "Direct Excitation of Xenon by Ballistic Electrons Emitted From Nanocrystalline Silicon Planar Cathode and Vaccum-Ultraviolet Light Emission," IDW, MEMS5-2, 2008, pp. 1363-1366.

(Continued)

*Primary Examiner* — Mary Ellen Bowman
(74) *Attorney, Agent, or Firm* — Antonelli, Terry, Stout & Kraus, LLP.

(57) ABSTRACT

To obtain effective luminance and light efficiency while avoiding discharge, it is necessary to sufficiently increase a current luminous efficiency of gas and an electron emission efficiency of an electron source. In a fluorescent lamp, an anode electric field is increased by setting a pressure of a noble gas or a molecular gas enclosed to 10 kPa or higher, setting an anode voltage to 240 V or lower, and setting a substrate distance to 0.4 mm or smaller. Furthermore, the resulting effect that the current luminous efficiency is increased in proportion to the electric field is used. Also, by applying a MIM electron source having an electron emission efficiency exceeding 10% as an electron source, a non-discharge fluorescent lamp having a light emission luminance equal to or larger than $10^4$ [cd/m$^2$] and a light emission efficiency equal to or larger than 120 [lm/W] is achieved.

16 Claims, 30 Drawing Sheets

(56) References Cited

U.S. PATENT DOCUMENTS

| | | | | |
|---|---|---|---|---|
| 6,512,330 | B2 * | 1/2003 | Nakajima et al. | 313/586 |
| 7,126,279 | B2 * | 10/2006 | Okada et al. | 313/582 |
| 2002/0171361 | A1 * | 11/2002 | Akiba | 313/582 |
| 2003/0146699 | A1 * | 8/2003 | Lee | 313/582 |
| 2004/0256975 | A1 | 12/2004 | Gao et al. | |
| 2007/0120486 | A1 | 5/2007 | Jang et al. | |
| 2007/0229407 | A1 | 10/2007 | Kang et al. | |
| 2008/0067917 | A1 | 3/2008 | Komatsu et al. | |
| 2008/0272685 | A1 | 11/2008 | Ikeda et al. | |

FOREIGN PATENT DOCUMENTS

| | | |
|---|---|---|
| JP | 2001-76613 | 3/2001 |
| JP | 2002150944 | 5/2002 |
| JP | 2003518705 | 6/2003 |
| JP | 2005149779 | 6/2005 |
| JP | 2005353419 | 12/2005 |
| JP | 2006004954 | 1/2006 |
| JP | 2007-165172 | 6/2007 |
| JP | 2008270034 | 11/2008 |
| JP | 2009009822 | 1/2009 |
| JP | 2010062071 | 3/2010 |
| WO | WO2010/005026 | 7/2009 |

OTHER PUBLICATIONS

Search report issued in connection with corresponding European Appln No. 10821761.3, dated Dec. 6, 2013.

* cited by examiner

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

TOP VIEW

A-A' SECTIONAL VIEW

B-B' SECTIONAL VIEW

TOP VIEW

A-A' SECTIONAL VIEW

B-B' SECTIONAL VIEW

A-A' SECTIONAL VIEW

B-B' SECTIONAL VIEW

TOP VIEW

A-A' SECTIONAL VIEW

FIG. 30

| | | FIRST EXAMPLE | A | B | C | D |
|---|---|---|---|---|---|---|
| GAP | d [mm] | 3 | 0.3 | 0.1 | 0.1 | 0.1 |
| ANODE VOLTAGE | Va [V] | 600 | 60 | 60 | 60 | 60 |
| ANODE CURRENT | Ia [uA] | 1 | 10 | 270 | 270 | 2700 |
| ANODE CURRENT DENSITY | Ja [A/m$^2$] | 2.00E−03 | 2.00E−02 | 5.40E−01 | 5.40E−01 | 5.4 |
| LUMINANCE | L [cd/m$^2$] | 1.12E+0.1 | 1.12E+02 | 9.07E+03 | 5.34E+03 | 5.34E+04 |
| CURRENT LUMINOUS EFFICIENCY | L/Ja [cd/A] | 5.60E+03 | 5.60E+03 | 1.68E+04 | 9.88E+03 | 9.88E+03 |
| INTERNAL LUMINOUS EFFICIENCY | $\eta$ int [lm/W] | 2.93E+01 | 2.93E+02 | 8.80E+02 | 5.17E+02 | 5.17E+02 |
| DIODE VOLTAGE | Vd [V] | 11 | 11 | 11 | 11 | 11 |
| DIODE CURRENT DENSITY | Jd [ A/m$^2$ ] | 2.00E−01 | – | – | – | 5.40E+01 |
| EXTERNAL LUMINOUS EFFICIENCY | $\eta$ ext [lm/W] | 1.03E+01 | – | – | – | 1.83E+02 |

【CALCULATION ASSUMPTIONS】

A: ANODE VOLTAGE AND GAP ARE REDUCED TO 1/10 (ANODE CURRENT × 10)

B: ONLY GAP IS REDUCED TO 1/3 (CURRENT LUMINOUS EFFICIENCY × 3, ANODE CURRENT × 27)

C: GREEN-COLOR LUMINANCE IS CONVERTED TO WHITE-COLOR LUMINANCE (× 1/1.7, PDP ACTUAL VALUE)

D: ANODE CURRENT DENSITY IS MULTIPLIED BY TEN

↑

Ja BECOMES TENFOLD WITH EMITTER ELECTRON EMISSION EFFICIENCY OF 10% (MIM-FED ACTUAL VALUE)

FLUORESCENT LAMP AND IMAGE DISPLAY APPARATUS

TECHNICAL FIELD

The present application describes an invention relating to a fluorescent lamp and a display apparatus using fluorescence.

BACKGROUND ART

Straight-tube fluorescent lamps have been widely available as general illumination, and their luminous efficiency is as extremely high as 100 lm/W to 120 lm/W. In recent years, however, under the environmental regulations in Europe and others, for example, the RoHS regulations, there have been active movements for demanding new illumination lamps using no Hg. Typical candidates thereof include LED and OLED illuminations, but fluorescent lamps such as Xe lamps using no mercury have also been reviewed.

PRIOR ART DOCUMENTS

Patent Documents

Patent Document 1: Japanese Unexamined Patent Application Publication No. 2005-353419

Patent Document 2: Japanese Unexamined Patent Application Publication No. 2002-150944

Patent Document 3: Japanese Unexamined Patent Application Publication No. 2006-004954

Patent Document 4: Japanese Unexamined Patent Application Publication No. 2001-006565

Patent Document 5: Japanese Unexamined Patent Application Publication No. 2009-009822

Non-Patent Documents

Non-Patent Document 1: T. Ichikawa, et al., IDW' 08, MEMS 5-2 p. 1363 (2008)

SUMMARY OF THE INVENTION

Problems to be Solved by the Invention

A problem in a Xe lamp using no mercury lies in a large power consumption due to a high discharge voltage. Patent Documents 2 to 4 disclose that, in order to decrease a discharge voltage, an electron source is provided in a tube to emit electrons into space, thereby decreasing a discharge starting voltage. A thermionic emission element is used in Patent Document 2, and a MIS (metal/insulator/semiconductor)-stacked type electron emission element called a BSD (Ballistic electron Surface-emitting Diode) is used in Patent Documents 3 and 4. On the other hand, Patent Document 1 and Non-Patent Document 1 disclose examples in which elimination of discharge itself is studied. Normally, in gas discharge, illumination is achieved by bringing Xe atoms to an excited state and converting emitted ultraviolet rays to visible rays with a fluorescent material. According to detailed analyses, however, approximately forty percent of power is consumed for heat and lost during above visible ray emission.

Intrinsically, energy of about 10 eV is sufficient to bring Xe atoms to an exited state. However, in case of using gas discharge, a most of the input power is consumed to the ionization energy of Xe atoms and kinetic energy of electrons and Xe ions, and excessive energy eventually becomes a heat loss. Therefore, if Xe atoms can be excited directly with electrons without the discharge, a significant improvement in efficiency can be expected. Patent Document 1 discloses a technology regarding a MIM (metal/insulating film/metal) electron source, and Non-Patent Document 1 discloses a technology regarding the above-described BSD electron source. A light-emitting phenomenon without discharge is described in the latter. However, although the operating conditions are described therein, luminance and efficiency are not mentioned at all. Moreover, Patent Document 1 just describes general information about the structure, and does not include any specific description about the material, device structure, manufacturing process, operating conditions, and performances (luminance and efficiency). More specifically, the two documents mentioned above do not disclose any means or methods by which a non-discharge fluorescent lamp with a direct excitation type can achieve practical performances, that is, practicable luminance and efficiency.

The inventors of the present invention have carried out an experiment for a non-discharge gas lamp with a direct gas-excitation type using a MIM electron source as an electron source, and have found a new experimental fact that a current luminous efficiency described further below is proportional to an electric field. The present invention shows the principle thereof and discloses the specific structural requirements necessary for achieving the performance equivalent to or higher than that of a conventional straight-tube fluorescent lamp.

Means for Solving the Problems

The problems described above can be solved by the following means.

That is, the problems are solved by a fluorescent lamp and an image display apparatus using the fluorescent lamp, the fluorescent lamp including: a front substrate and a back substrate facing each other; a container configured of walls surrounding the front substrate and the back substrate; an electron source placed on a front substrate side of the back substrate and emitting hot electrons; a fluorescent material placed on a back substrate side of the front substrate, absorbing ultraviolet rays, and converting into visible light emission; a noble gas or a molecular gas enclosed in the container; and electrodes provided on the front substrate and the back substrate, in which the hot electrons emitted into the noble gas or the molecular gas are collected by applying an anode voltage between the electrodes, and a current luminous efficiency obtained by dividing a luminance L of the visible light emission by an anode current density is proportional to a value of an anode electric field obtained by dividing the anode voltage by a substrate distance between the front substrate and the back substrate.

Furthermore, the problems are solved by another invention of the present invention. That is, the problems are solved by a fluorescent lamp and an image display apparatus using the fluorescent lamp, the fluorescent lamp including: a front substrate and a back substrate facing each other; a container configured of walls surrounding the front substrate and the back substrate; an electron source placed on a front substrate side of the back substrate and emitting hot electrons; a fluorescent material placed on a back substrate side of the front substrate, absorbing ultraviolet rays, and converting into visible light emission; a noble gas or a molecular gas enclosed in the container; and electrodes provided on the front substrate and the back substrate, in which the hot electrons emitted into the noble gas or the molecular gas are collected by applying an anode voltage between the electrodes, the gas pressure is equal to or higher than 10 kPa, the anode voltage is equal to or lower than 240 V, and a substrate distance is equal to or smaller than 0.4 mm.

Effects of the Invention

By using the fact that the current luminous efficiency is proportional to an anode voltage, it is possible to achieve a non-discharge fluorescent lamp having luminance and efficiency performance exceeding straight-tube fluorescent lamps.

BRIEF DESCRIPTIONS OF THE DRAWINGS

FIG. 30 is a table showing performances of luminance of non-discharge gas lamps.

BEST MODE FOR CARRYING OUT THE INVENTION

First, with respect to a non-discharge gas lamp with a direct gas-excitation type using a MIM electron source, novel findings as to current luminous efficiency obtained by the inventors of the present invention are disclosed.

Figure 1:
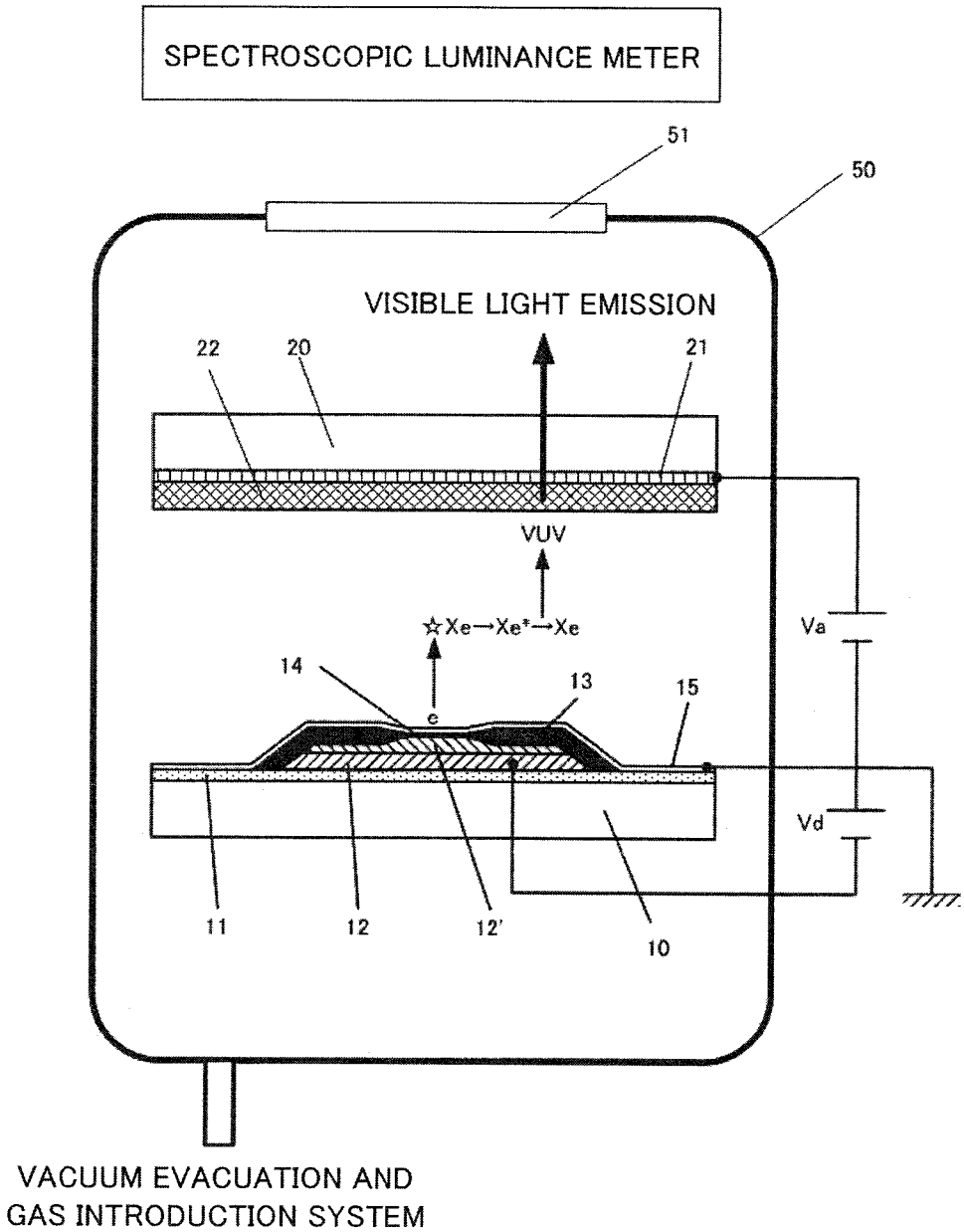
FIG. 1 is a view showing an example of structure of a non-discharge gas lamp.

FIG. 1 is a schematic view of an experimental system. A cathode substrate having a MIN electron source and an anode substrate having a florescent material disposed thereon are set to face each other with a certain distance therebetween in a vacuum container. A manufacturing method of the cathode substrate and the anode substrate used here is described in detail in a first example.

After the inside of the container is evacuated, Xe gas is introduced, and the inside of the container is kept at a certain pressure. As a gas type used here, a noble gas that emits vacuum ultraviolet (VUV) to ultraviolet (UV) light by excitation is suitable. Other than that, a molecular gas, for example, $N_2$ or the like can be used because there is no need to worry about dissolution accompanied by discharge.

Subsequently, from the outside of the vacuum container, a gap voltage Va is provided between an upper electrode 15 of the MIM electron source and an anode electrode 21 from a DC power supply. This is to draw and collect electrons emitted from the MIM electron source into the Xe gas to the anode electrode. Also, a driving pulse having a predetermined voltage Vd, pulse width, and cycle is applied between a lower electrode and the upper electrode of the MIM electron source from a DC pulse power supply.

Experiment conditions and light-emitting performance are shown in a column "First Example" of FIG. 30.

Definitions of various physical quantities used here are described below.

A luminous flux $\phi$ of a non-discharge gas lamp is represented by the following equation 1.

$$\text{Luminous flux } \phi = \pi \times \text{luminance } L \times \text{area } S = \eta \times P \quad \text{[Equation 1]}$$

Here, $\eta$ is a luminous efficiency and P is a power consumption. Here, when an internal luminous efficiency is $\eta$int, $$\text{Internal luminous efficiency } \eta int = \pi \cdot L/(Va \times Ja) \quad \text{[Equation 2]}$$

is defined. Va is a voltage applied to a space between the anode substrate and the cathode substrate, and Ja is a density of a current flowing therethrough.

In Equation (2), L/Ja is defined as a current luminous efficiency.

As can be seen from this FIG. 30, the current luminous efficiency reaches $5.6\times10^3$ [cd/A] when an anode electric field is $2\times10^5$ [V/m] and a pressure is 60 kPa.

The internal luminous efficiency at this time is 29.3 [lm/W]. In the internal luminous efficiency, only the power to be consumed in the gas is considered. The efficiency in additional consideration of the power to be consumed by the electron source is defined as an external luminous efficiency.

$$\text{External luminous efficiency } \eta ext = \pi \cdot L/(Va \times Ja + Vd \times Jd) \quad \text{[Equation 3]}$$

Vd represents a voltage applied to the MIM diode, and Jd represents a current flowing through the MIM diode.

In the BSD and MIM described above, a proportional relation holds between Ja and Jd, and its proportional coefficient is called an electron emission efficiency $\alpha$.

$$Ja = \alpha \cdot Jd \quad \text{[Equation 4]}$$

In this experiment, since the electron emission efficiency is 1% and the diode voltage is 11 V, when Jd is found from Equation (4) and is then substituted into Equation (3), an external luminous efficiency is obtained as 10.3 [lm/W]. This value is approximately equal to that of an incandescent lamp, but is insufficient for a practical luminance.

The low internal luminous efficiency in spite of a high current luminous efficiency is caused by a high anode voltage of 600 V. Accordingly, in order to decrease the voltage, a substrate distance d between the anode substrate and the cathode substrate and the anode voltage Vd are reduced to 1/10 so that the anode electric field keeps constant. An anode current Ia (=Ja×S, S is an area of a light-emitting region) follows a space-charge limited current shown below.

$$\text{Space-charge limited current } Ia = (9/8) \times \epsilon \times \mu \times Vd^2/d^3 \quad \text{[Equation 5]}$$

$\epsilon$: permittivity $\mu$: electron mobility

With an effect of a $d^{-3}$ term by the proportional reduction described above, the anode current Ia is increased tenfold. As a result, the luminance L and the internal luminous efficiency are improved tenfold (refer to column "A" in FIG. 30).

Figure 3:
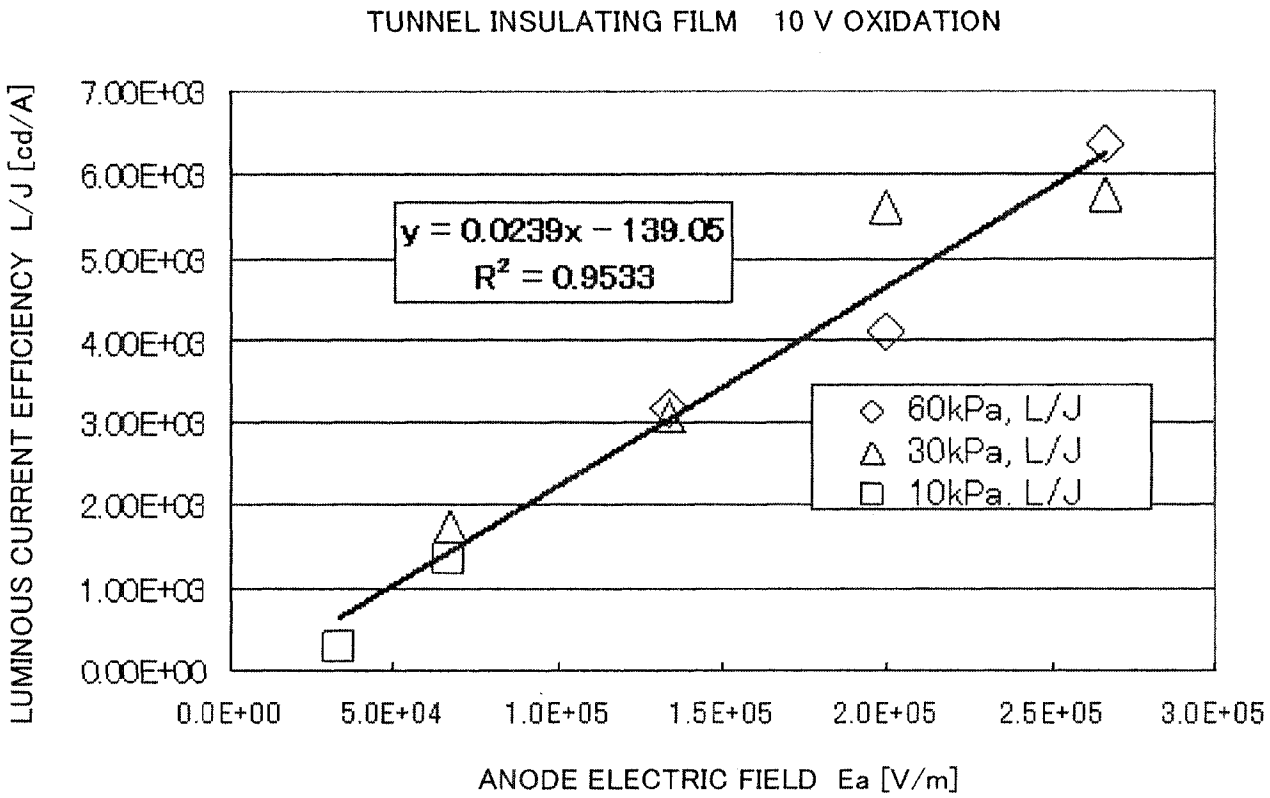
FIG. 3 is a drawing showing anode electric field dependency of current luminous efficiency of the non-discharge gas lamp.

Furthermore, as shown by the first example with reference to FIG. 3, the fact that the current luminous efficiency is proportional to the anode electric field has been found. By using this effect, the distance d is further reduced to 1/3. By this means, the current luminous efficiency is improved to $1.7\times10^4$ [cd/A] and the anode current Ia is also increased twenty-sevenfold at the same time from Equation (5). Therefore, the luminance L is improved to $9.1\times10^3$ cd/m$^2$ (refer to column "B" in FIG. 30).

The studies so far have discussed the luminance and efficiency of a single green color, and these are converted to luminance and efficiency of a white color. When an RGB fluorescent material for plasma display is used from among florescent materials disclosed in the first example, it is known that a conversion ratio therebetween is 1/1.7. Numerical values after the conversion correspond to those in column "C" in FIG. 30.

In the foregoing, measures for improving luminance and luminous efficiency by means of design of a panel have been disclosed.

However, to improve the external luminous efficiency, the performance of the electron source (anode current density Ja and electron emission efficiency $\alpha$) has to be improved.

Patent Document 5 discloses a technology regarding improvement in performance of a HIM electron source. Specifically, (1) decreasing Nd impurities in a tunnel insulating film to a certain value or lower; and (2) changing the film thickness of the tunnel insulating film from 4 V to 6 V oxidation are described. In the present invention, in addition to these, (3) increasing an oxidation voltage of the tunnel insulating film to 8 V or higher;

(4) decreasing a work function by covering the surface of the upper electrode with a Cs oxide; and (5) heating the panel in vacuum to cause a precious metal thin film of Au/Pt/Ir to become thinner by itself are performed, thereby achieving an anode current density Ja of 2000 [A/m$^2$] and a current use efficiency of 10%. In consideration of the above two improvement measures, as shown in column "D" of FIG. 30, it has been found that a light source with high luminance and high efficiency having an anode current density Ja of 5.4 [A/m$^2$], a luminance L of $5.3\times10^4$ [cd/m$^2$] and an external luminous efficiency of 183 [lm/W] exceeding those of the straight-tube fluorescent lamp can be achieved.

When the discussions above are summarized, the internal luminous efficiency is inversely proportional to the gap distance (substrate distance) d. Instead of the lamp with an ultrahigh efficiency described above, even the lamp with a luminous efficiency of 50 lm/W, which is at a level of a downlight-type LED illumination, can be used as illumination. More specifically, even when the gap distance is widened up to approximately fourfold, practicability thereof is not impaired. In this case, however, since the current luminous efficiency is required to be kept constant, that is, the electric field is required to be kept constant, the anode voltage is required to be increased fourfold. Therefore, to obtain the luminous efficiency equal to or higher than that of the downlight-type LED illumination, the gap distance is preferably equal to or shorter than 0.4 mm and the anode voltage is preferably equal to or lower than 240 V. When the conditions in the column D of FIG. 30, that is, an anode voltage of 60 V and a gap distance of 0.1 mm are taken as a reference, if smallest values of the gap distance and the anode voltage are considered while maintaining the same electric field intensity, the gap distance is 0.01 mm and the anode voltage is 6 V. The gap distance is preferably set to be equal to or larger than the size of the particle diameter of the fluorescent material. Also, glass panels are bonded to form a container, and if the gap distance is too narrow, displacement with gas cannot be achieved successfully. Also from this viewpoint, it can be said that even the gap distance equal to or longer than 0.01 mm is acceptable.

Embodiments of the present invention are described in detail below with reference to the drawings of examples.

FIRST EXAMPLE

Here, results of performance verification experiment on a non-discharge gas lamp to be the support of the present invention are disclosed.

Figure 4A:
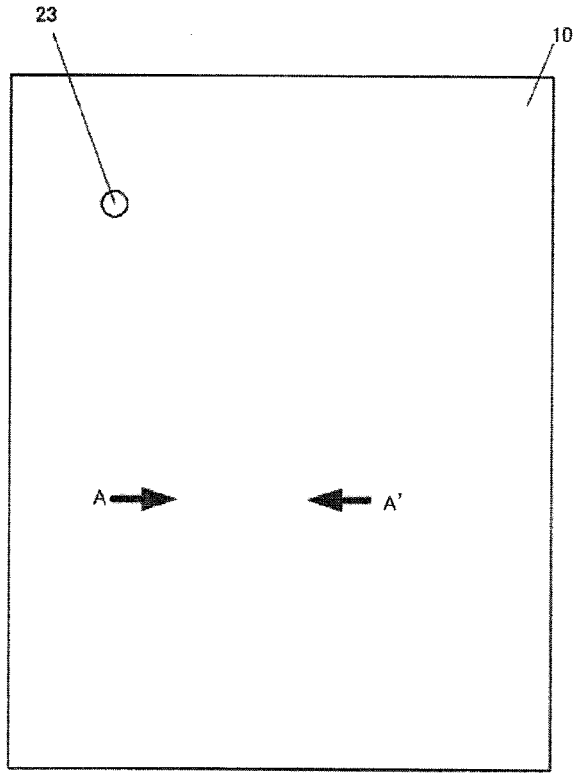
FIG. 4(A) is a view showing an example of a manufacturing method of a non-discharge gas lamp in a first example.
Figure 4B:
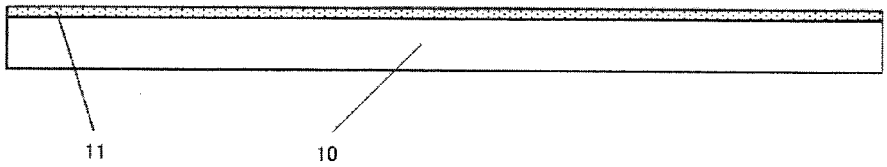
FIG. 4(B) is a sectional view taken along the line A-A' in FIG. 4(A)

First, a manufacturing method of an electron source is described. As shown in FIG. 4, as a cathode substrate 10, inexpensive soda lime glass which is an insulating material is prepared. To prevent the diffusion of alkaline components from the soda glass substrate, an alkali diffusion preventive film 11 is provided on a glass surface. As a diffusion preventive film, an insulating film mainly made of silicon oxide, silicon nitride, or others is suitable. Here, an inorganic polysilazane film that can be applied by spin coating is used. After this is applied by a spin coater, it is heated in a normal atmosphere at 250° C. and is transformed to a silica film. In addition, firing in a nitrogen atmosphere at 550° C. is performed for heat shrinkage. This firing is performed in advance at a temperature higher than 400° C. in order to prevent the further shrinkage of the silica film by the temperature of 400° C. of the fritted glass sealing in the process of manufacturing a lamp. By this means, effects of eliminating thermal stress to the MIM electron source associated with heat shrinkage and preventing the occurrence of a void or hillock in Al alloy which causes defects in a tunnel insulating film can be achieved.

Next, a film of Al alloy serving as a lower electrode of the MIM electron source is formed by sputtering. As the Al alloy, Al alloy having a composition whose heat resistance is reinforced so as to prevent the occurrence of a void or hillock in the heat treatment of the fritted glass sealing described above and obtained by adding one or a plurality of metals of the 3A group, 4A group, or 5A group in the periodic table is suitable. Here, two types of Al—Nd alloys having different additive amounts are used. First, after a film having a thickness of 300 nm is formed by using an alloy target with a Nd content of 2 atom %, a film having a thickness of 200 nm is sequentially stacked by using an alloy target with 0.6 atom %. An oxide film is formed on the surface of this stacked Al alloy film by anodic oxidation, thereby forming a tunnel insulating film. The tunnel insulating film includes a certain concentration of Nd which is an additive to the alloy. The mixed Nd forms an electron trap in an energy gap in alumina, which causes a decrease in diode current and degradation in electron emission efficiency. In a prior study using an FED (Field Emission Display) panel having a MIM electron source, in the case of an anodic oxidation voltage of 4 V, when the Nd content is changed from 2 atom % to 0.6 atom %, the electron emission efficiency of the MIM electron source obtained is doubled from 3.3% to 5.5%. From this fact, it has found that the Nd content should be equal to or lower than 1 atom % in order to obtain an electron emission efficiency exceeding 5%.

Figure 5A:
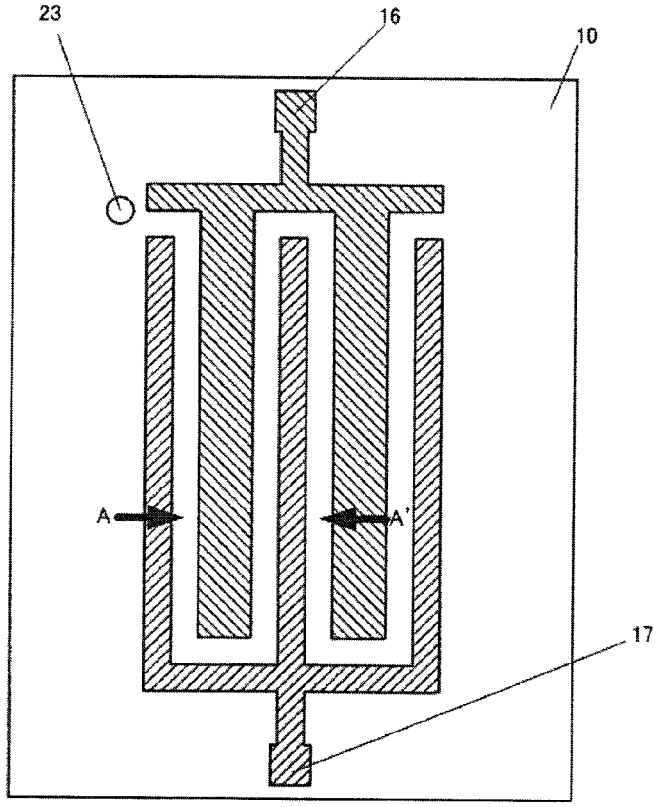
FIG. 5(A) is a view showing an example of the manufacturing method of the non-discharge gas lamp in the first example.
Figure 5B:
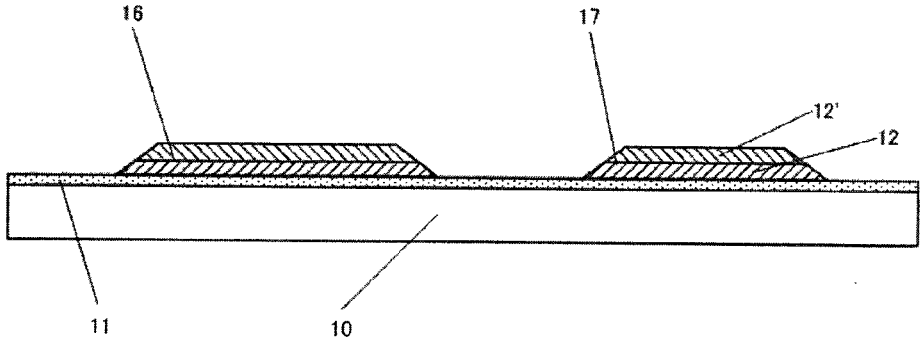
FIG. 5(B) is a sectional view taken along the line A-A' in FIG. 5(A)

After the film formation, through a photolithography process and an etching process, a pair of a lower electrode 16 and an upper electrode bus wiring 17 each in a comb-tooth shape as shown in FIG. 5 is formed. As the etching, wet etching using a mixed aqueous solution of, for example, phosphoric acid, acetic acid, and nitric acid as etching solution is suitable.

Figure 6A:
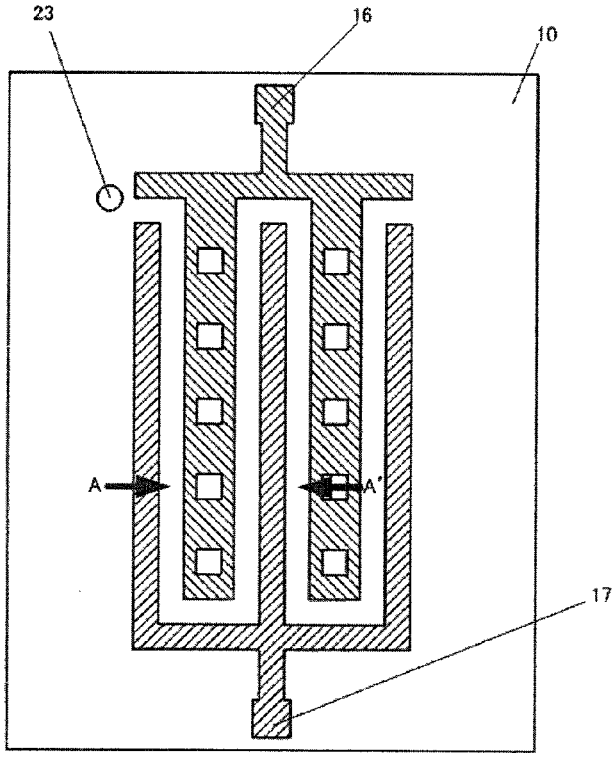
FIG. 6(A) is a view showing an example of the manufacturing method of the non-discharge gas lamp in the first example.
Figure 6B:
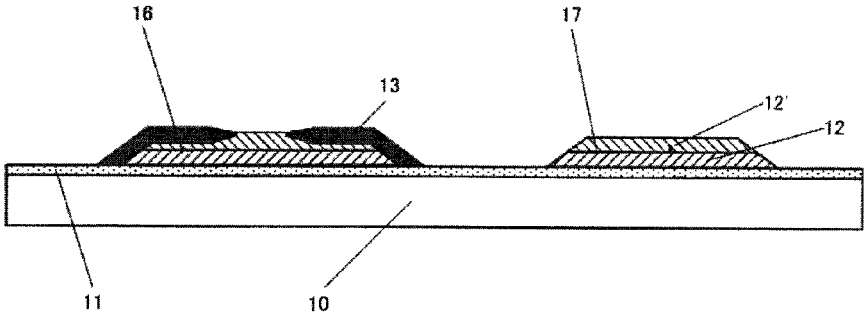
FIG. 6(B) is a sectional view taken along the line A-A' in FIG. 6(A)

In FIG. 6, a resist pattern is provided on a part of the lower electrode 16 and the surface is locally anodized. As the conditions for the anodic oxidation, a counter electrode is a Pt plate, an electrolyte is composed of a mixed solution of ammonium tartrate aqueous solution and ethylene glycol, the temperature is a room temperature, an oxidation current is 100 uA/cm$^2$, and an oxidation voltage is 100 V. By this means, a field insulating film 13 of approximately 140 nm is formed. On the other hand, during this time, the upper electrode bus wiring 17 is covered with a resist and is set in a floating state, thereby preventing the growth of the field insulating film 13.

Figure 7A:
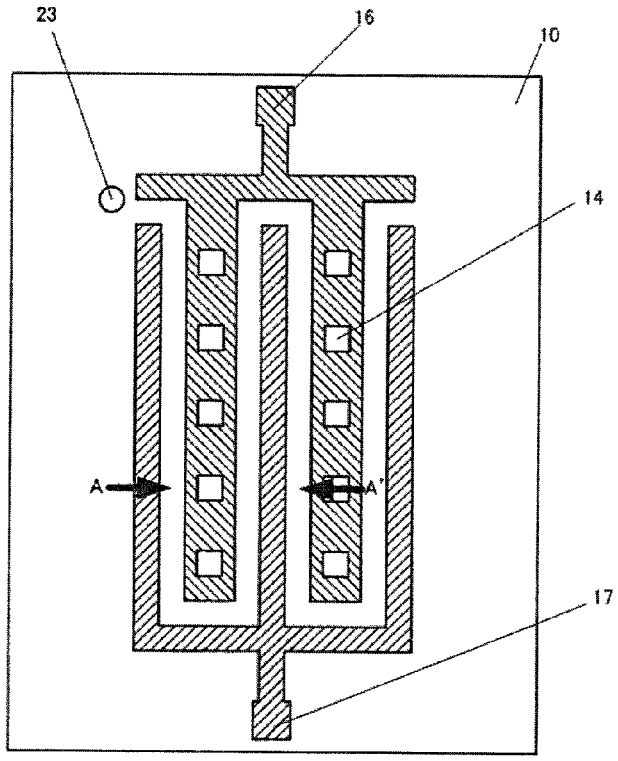
FIG. 7(A) is a view showing an example of the manufacturing method of the non-discharge gas lamp in the first example.
Figure 7B:
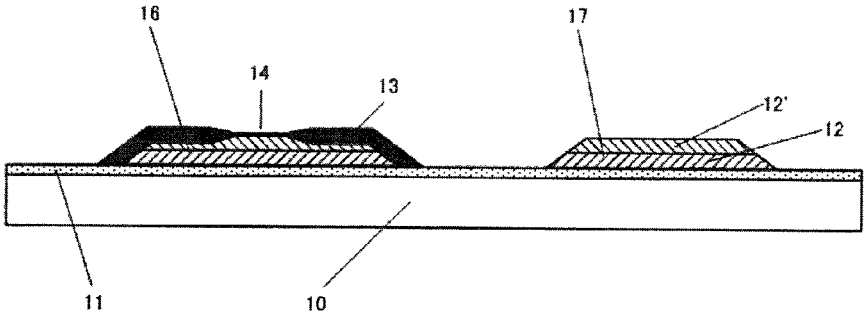
FIG. 7(B) is a sectional view taken along the line A-A' in FIG. 7(A)

Subsequently, as shown in FIG. 7, the resist pattern used for local oxidation is peeled off, and the surface of the lower electrode 16 is again anodized to form a tunnel insulating layer 14 which is to be an electron accelerating layer. As the conditions for the anodic oxidation, a counter electrode is a Pt plate, an electrolyte is composed of a mixed solution of ammonium tartrate aqueous solution and ethylene glycol, the process is a room-temperature process, an oxidation current is 10 uA/cm$^2$, and an oxidation voltage is set within a range from 4 V to 20 V. At this time, no oxidation is performed in a region where an oxide film has already grown, and an oxide film of approximately 10 nm grows only in a region covered with the resist in the preceding process. In this manner, the field insulating film 13 is formed in a surrounding region of the tunnel insulating film 14.

Figure 8A:
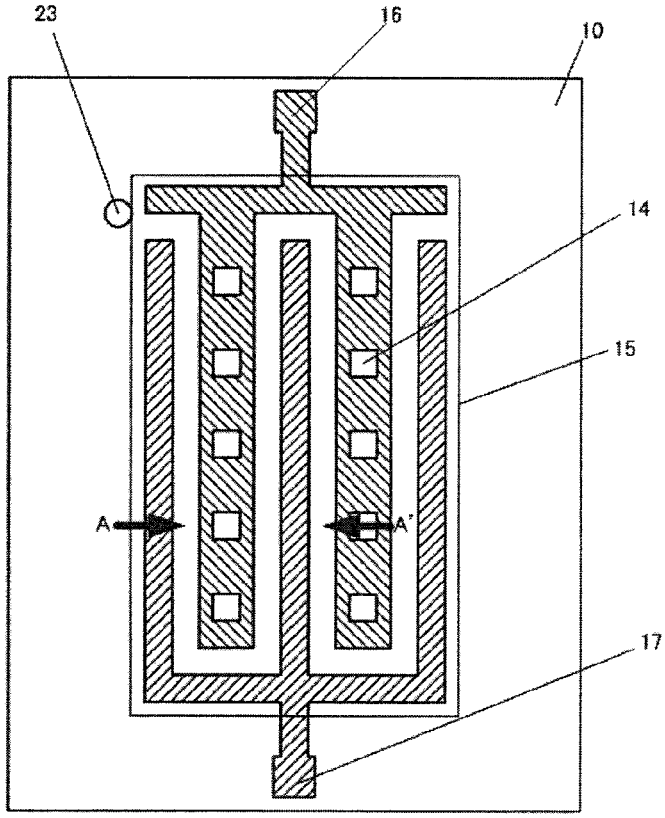
FIG. 8(A) is a view showing an example of the manufacturing method of the non-discharge gas lamp in the first example.
Figure 8B:
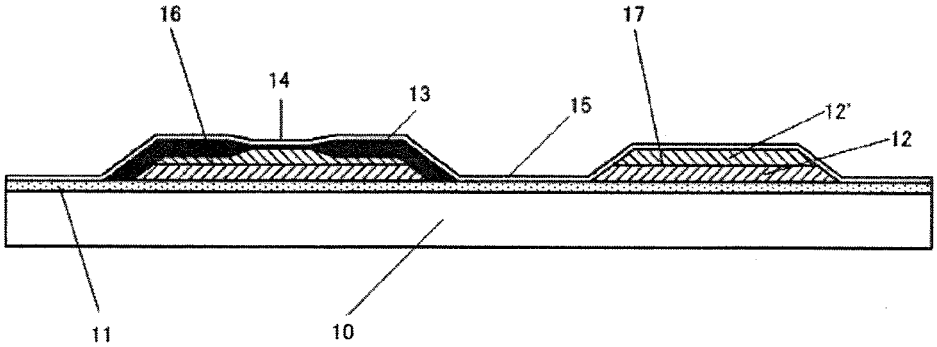
FIG. 8(B) is a sectional view taken along the line A-A' in FIG. 8(A)

As shown in FIG. 8, an upper electrode 15 is formed at a portion which is to be a light-emitting region. For the film formation, mask film formation using an in-line DC-type magnetron sputter apparatus is suitable. Sputtering is performed successively in the order of Ir, Pt, and Au without breaking vacuum, thereby obtaining the upper electrode 15 formed of an Au/Pt/Ir stacked film. As a result, a cathode substrate in which a MIM electron source is formed on a lower electrode 16 side and a low resistance wiring connected to the upper electrode is formed on an upper electrode bus wiring 17 side has been completed.

Figure 9A:
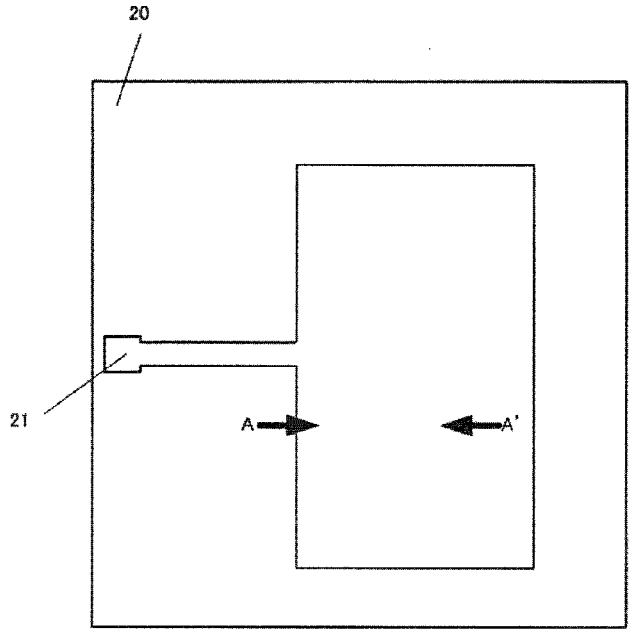
FIG. 9(A) is a view showing an example of the manufacturing method of the non-discharge gas lamp in the first example.
Figure 9B:
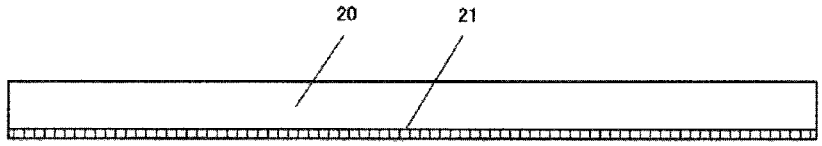
FIG. 9(B) is a sectional view taken along the line A-A' in FIG. 9(A)
Figure 10A:
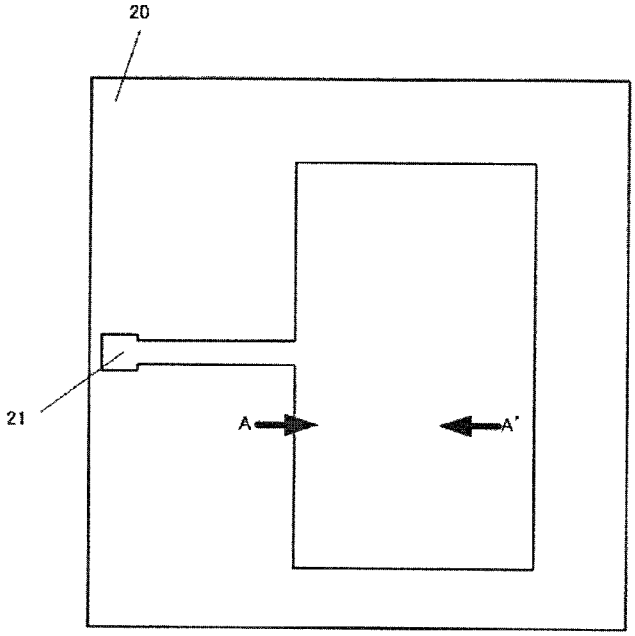
FIG. 10(A) is a view showing an example of the manufacturing method of the non-discharge gas lamp in the first example.
Figure 10B:
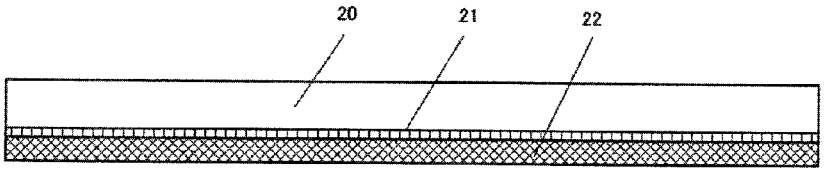
FIG. 10(B) is a sectional view taken along the line A-A' in FIG. 10(A)

Next, a manufacturing method of an anode substrate is described. In FIG. 9, a transparent insulating material to extract visible light emission to outside is required for an anode substrate 20, and glass is generally preferable. As a transparent conductive oxide film of the anode substrate 20, tin oxide or ITO film is formed, and an electrode is processed in a region where light emission is performed. For patterning, mask vapor deposition, mask sputtering, or photolithography and etching can be performed. In FIG. 10, a fluorescent material film is formed in a light-emitting region of the anode electrode 21. For the fluorescent material, a material which absorbs vacuum ultraviolet to ultraviolet light and emits visible light is used. Here, $Zn_2SiO_2$:Mn, which is often used for plasma display, absorbs VUV (vacuum ultraviolet light) of 147 nm and 173 nm from Xe gas, and emits green-colored light, is used. As a similar red-color fluorescent material, (Y, Gd)$BO_3$:Eu is suitable, and $BaMgAl_{14}O_{23}$:Eu is suitable for blue color. The fluorescent material is not limited to those described above, and calcium halophosphate for white color used in a fluorescent lamp, europium-activated yttrium oxide for red color, zinc silicate and cerium-terbium-activated magnesium aluminate for green color, calcium tungstate and europium-activated strontium chlorapatite for blue color, and others or a mixture thereof may be used.

To form a fluorescent material film 22, a paste obtained by mixing a fluorescent material with a binder and an organic solvent is prepared, and this is applied to a desired region by screen printing. By firing this in a normal atmosphere, the binder is burnt, thereby obtaining a fluorescent material film. Although it is possible to absorb all VUV when the film thickness is set to be equal to or larger than 10 um, if the thickness is too large, transmittance of visible light is decreased. Thus, the film thickness is preferably 2 um or larger and 10 um or smaller, and it is set to 8.5 um here so as to have visible light transmittance of about 25%.

The cathode substrate 10 and the anode substrate 20 manufactured in the above-described manner are set to face each other with a predetermined distance d of 3 mm therebetween as shown in FIG. 1, and are placed in a vacuum container 50. Electric wirings are connected to the anode electrode 21, the upper electrode bus wiring 17, and the lower electrode 16 so as to lead them out to the outside of the container. After the container is once evacuated, Xe gas is introduced at a desired pressure, for example, 10 kPa to 100 kPa.

In the vacuum container 50, a driving signal is provided to the anode electrode 21, the upper electrode bus wiring 17, and the lower electrode 12 via the electric wirings. The upper electrode bus wiring 17 is grounded, an anode voltage Va is applied to the anode electrode 21, and a diode voltage Vd is applied to the lower electrode 12. A DC potential from 0 V to 800 V is provided as the anode voltage Va and a bipolar pulse potential is applied as the diode voltage Vd at a constant repetition frequency. The current flowing through the anode electrode 21 and the upper electrode, that is, Ia and Id are measured by an ammeter. Also, the obtained visible light emission luminance L is measured by a spectroscopic luminance meter through a quartz glass window 51 provided to the vacuum container 50.

Figure 2:
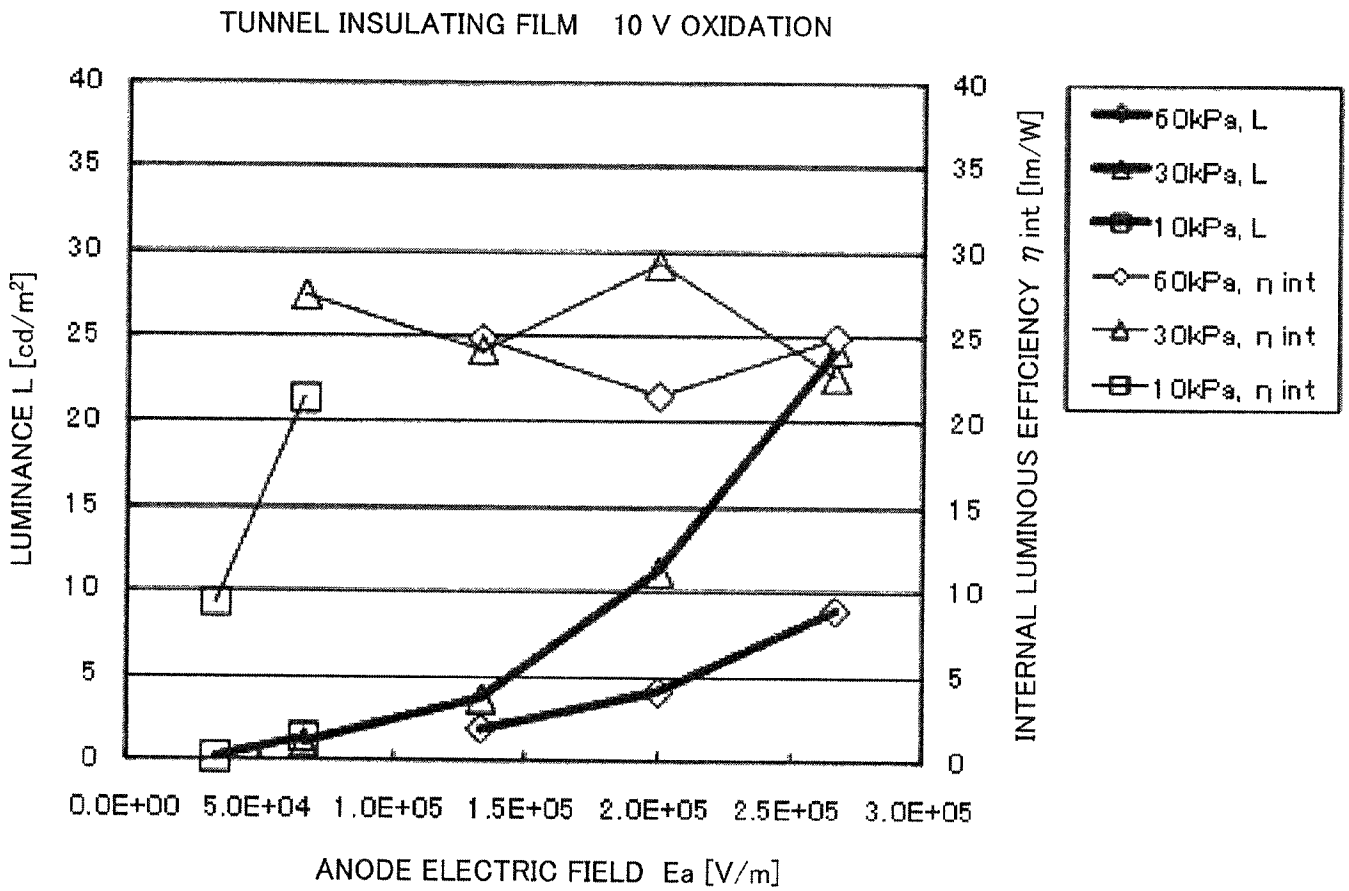
FIG. 2 is a drawing showing anode electric field dependency of luminance of the non-discharge gas lamp.

FIG. 2 shows a relation between the luminance L and an anode electric field Ea when the tunnel insulating film 14 is an anodic oxide film of 10 V. By dividing the anode voltage Va by the distance d, the anode electric field Ea can be obtained. Xe pressures are 10 kPa, 30 kPa, and 60 kPa. The luminance L is non-linearly increased in accordance with the anode electric field Ea. On the other hand, the internal luminous efficiency $\eta$int is approximately constant except for a low electric field region where the Xe pressure is 10 kPa. It has been found that, at a pressure of 10 kPa, discharge occurs when the electric field is equal to or larger than $5\times10^4$ [V/m], and the anode current Ia and the luminance L are increased, but conversely, the internal luminous efficiency mint becomes extremely small (<0.01 lm/W).

In general, a discharge phenomenon is less prone to occur at a high pressure. Therefore, in order to avoid discharge and cause a light-emitting phenomenon of the present invention, the Xe pressure is set to at least equal to or higher than 10 kPa, preferably equal to or higher than 30 kPa, and desirably equal to or higher than 60 kPa. As for an upper limit value of pressure, it has been found from the studies so far that the MIM electron source can emit electrons up to near atmospheric pressure. At a pressure equal to or higher than atmospheric pressure, the vacuum container and a glass container sealed with low-melting glass are structurally broken, and therefore an experiment cannot be performed. For this reason, as a lamp using a glass container, the pressure upper limit value is considered to be atmospheric pressure (105 kPa).

FIG. 3 is a graph showing a relation between the current luminous efficiency L/Ja and the anode electric field Ea. It can be found that a linear relation holds between them. The current luminous efficiency increases as the anode electric field becomes higher, but discharge occurs as described above unless the pressure is high at the same time. It can be found also from this that a pressure equal to or higher than 30 kPa is preferably used.

From the present example, new findings that the current luminous efficiency reaches 5000 cd/A when an anode electric field is $2\times10^5$ [V/m] and is also proportional to the electric field have been obtained. An experiment similar to this has been performed for cathode substrates each having a tunnel insulating film with anodic oxidation voltage of 4 V, 6 V, 8 V, 15 V, or 20 V. As a result, in a product of 4 V, light emission is confirmed, but it does not reach a measurable luminance. In the cathodes having an oxidation voltage equal to or higher than 6 V, light emission can be measured, and these cathodes are characteristically identical to a product of 10 V. From this fact, the oxidation voltage is equal to or higher than 6 V, and desirably equal to or higher than 10 V. This is because electron energy is increased as the oxidation voltage becomes higher.

SECOND EXAMPLE

Here, a manufacturing method of a non-discharge fluorescent lamp is disclosed. First, a through hole is provided in advance in the cathode substrate 10 in FIG. 8 of the first example so that the inside of the lamp is evacuated and gas is introduced. In addition, in order to improve the electron emission efficiency to 10%, a process of decreasing a work function is performed. More specifically, before the formation of the upper electrode 15, the cathode substrate 10 is immersed in an aqueous solution containing an alkali metal oxide salt and is then dried, thereby absorbing the alkali metal oxide salt onto the surface. As an alkali metal salt, carbonate or hydrogen carbonate which is likely to be thermally decomposed by a heat treatment of subsequent frit sealing to be an alkali metal oxide is preferable. Also, as an alkali metal effective for decreasing the work function, a metal with a larger atomic number is advantageous. From the above viewpoint, a $CsHCO_3$ aqueous solution is preferable.

Figure 11A:
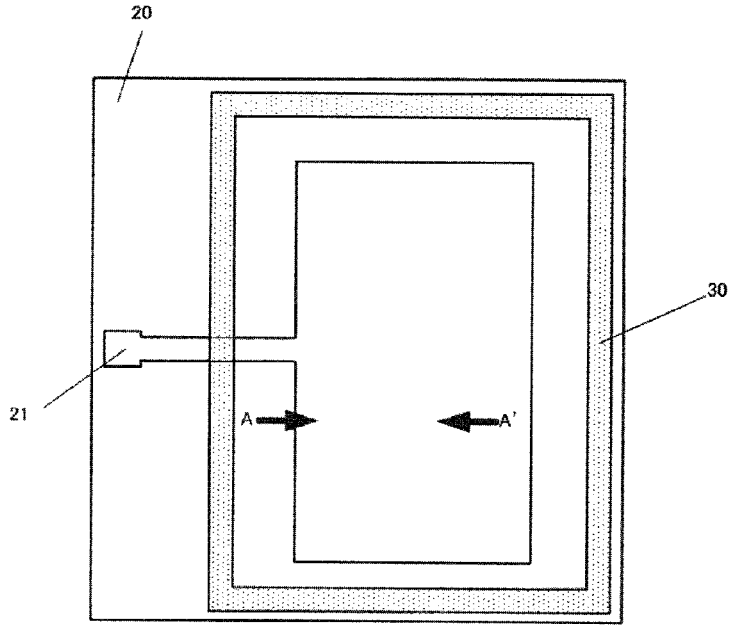
FIG. 11(A) is a view showing an example of a manufacturing method of a non-discharge gas lamp in a second example.
Figure 11B:
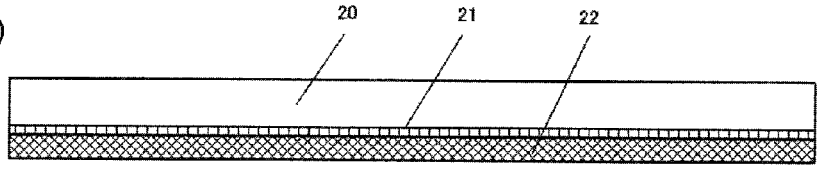
FIG. 11(B) is a sectional view taken along the line A-A' in FIG. 11(A)

On the cathode substrate 10 subjected to the work function decreasing process, the upper electrode 15 is formed in the same manner as the first example. Subsequently, as shown in FIG. 11, a frit seal 30 serving as a wall of the container is formed on the anode substrate 20 manufactured in the first example. The material of the frit seal 30 is low-melting glass, and its main component is PbO in a lead-based one and B—Si, Bi—P, or the like in a non-lead-based one. For the pattern formation of the frit seal 30 on the anode substrate 20, screen printing or a dispenser is suitable. In the pasted frit seal material, beads having a predefined diameter are preferably mixed so as to control the distance d. After printing the frit seal 30, the anode substrate 20 is fired in a normal atmosphere at a temperature equal to or higher than the melting point to remove the binder and the organic solvent contained in the paste. From the viewpoint of the simplification of the process, this process is preferably performed simultaneously with the firing process of the fluorescent material 22.

Figure 12A:
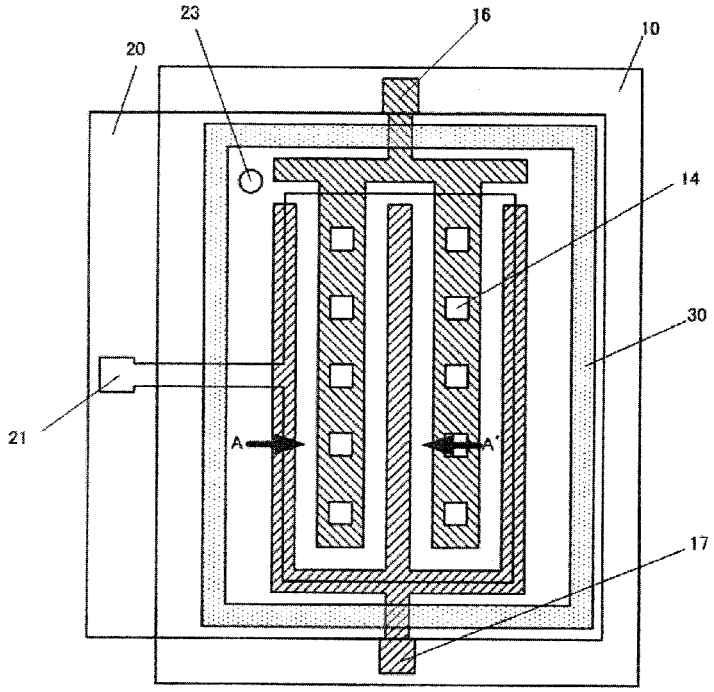
FIG. 12(A) is a view showing an example of the manufacturing method of the non-discharge gas lamp in the second example.
Figure 12B:
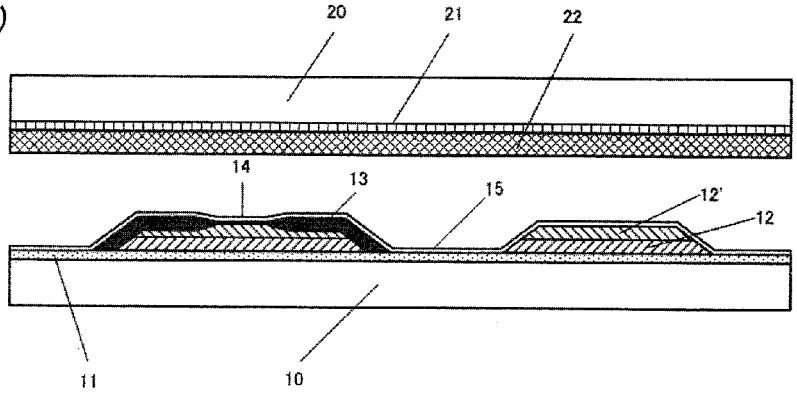
FIG. 12(B) is a sectional view taken along the line A-A' in FIG. 12(A)

The cathode substrate 10 and the anode substrate 20 manufactured in the above-described manner are aligned so as to face each other as shown in FIG. 12 and are then sealed, thereby forming as an integrated glass container. At this time, a pattern is designed so that terminals of the respective electrodes (16, 17, and 21) are exposed of an edge end of the glass.

In a sealing process, the temperature is first increased in a normal atmosphere to the melting point of the seal material or higher for fusion, and subsequently, vacuum evacuation is performed from the through hole 23 in a state in which the temperature is decreased to be slightly lower than the melting point, thereby performing so-called gas exhaustion. After the gas exhaustion is performed for a predetermined period of time, the temperature is gradually decreased to a room temperature, and Xe gas is finally introduced at a predetermined pressure for glass sealing of an exhaust pipe, thereby completing a lamp.

Through this sealing process, the work function decreasing process is completed for the upper electrode 15. More specifically, $CsHCO_3$ is thermally decomposed by the atmospheric firing at a temperature of the melting point or higher and is changed to CsO, and in the subsequent heat treatment in vacuum, the upper electrode 15 itself is structurally changed to become thinner. At the same time, thermally diffused Cs covers the Au surface of the upper electrode 15 to decrease the work function by approximately 0.5 eV. In addition, since absorption gas or the like disappears due to heating in vacuum, the electron emission efficiency of the MIM electron source reaches well above 10%.

When the non-discharge Xe lamp thus created is lit up with an anode voltage of 60 V and under operating conditions of the MIM electron source of Vd=11 V, a pulse width of 30 usec, and a repetition frequency of 600 Hz, performance of approximately 10000 cd/$m^2$ and a light-emitting luminance of 150 lm/W is obtained as a white luminance at the time of input of 60 W. Here, while the MIM electron source is pulse-driven, the amount of light emission can be adjusted by changing the height or width of the pulse.

THIRD EXAMPLE

When the size of the lamp is increased, due to the vacuum evacuation in the sealing process or the depressurization (<1 atmospheric pressure) of the enclosed Xe gas, the panel cannot bear the atmospheric pressure and the distance d becomes non-uniform, and at worst, the panel may be buckled to be broken. For its prevention, a rib serving as a support strut may be formed in a light-emitting region.

Figure 13A:
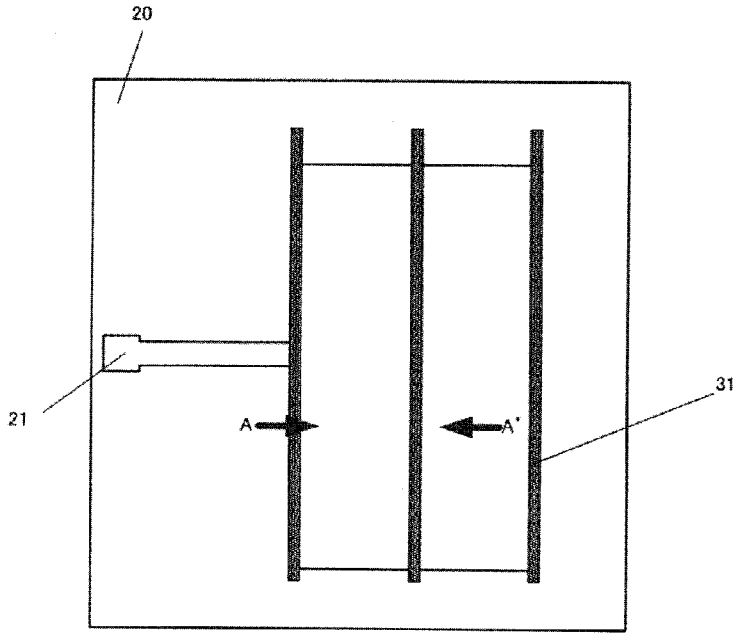
FIG. 13(A) is a view showing an example of a manufacturing method of a non-discharge gas lamp in a third example.
Figure 13B:
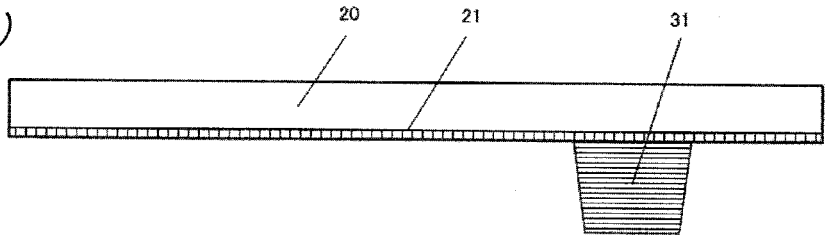
FIG. 13(B) is a sectional view taken along the line A-A' in FIG. 13(A)

As shown in FIG. 13, ribs 31 are formed on the anode electrode 21. As a material of the ribs 31, low-melting glass similar to the frit seal 30 described above is suitable, and one having a melting point higher than that of the frit seal 30 is preferable. As for a pattern forming method, photolithography may be used by providing photosensitivity in advance. If there is no photosensitivity, after a uniform film is once formed by screen printing or the like and a mask is provided using a photoresist, it may be scraped by sandblasting or the like.

Figure 14A:
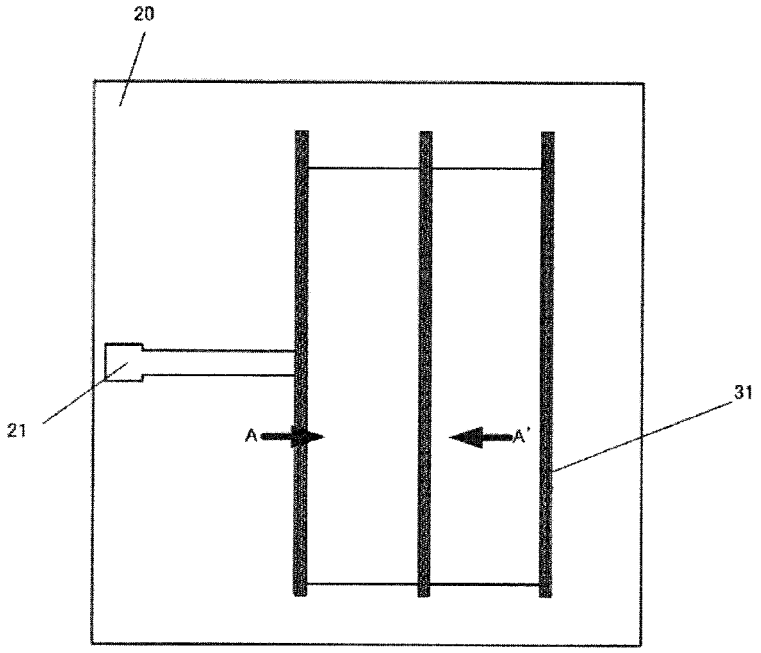
FIG. 14(A) is a view showing an example of the manufacturing method of the non-discharge gas lamp in the third example.
Figure 14B:
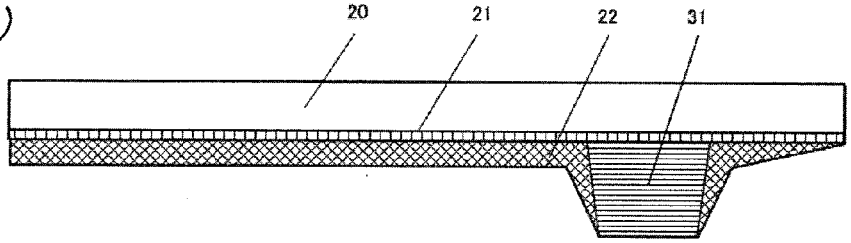
FIG. 14(B) is a sectional view taken along the line A-A' in FIG. 14(A)

FIG. 14 shows the state of forming the fluorescent material film 22 on the anode substrate 20 having the ribs 31 disposed thereon. The fluorescent material is disposed by screen printing or the like so as not to be attached onto the upper surface of the rib 31, but this shall not apply when color mixture poses no problem.

Figure 15A:
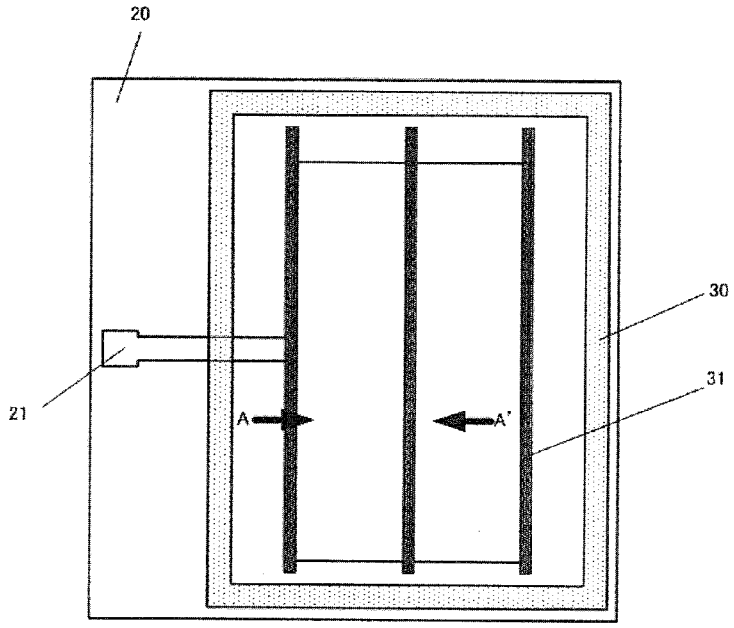
FIG. 15(A) is a view showing an example of the manufacturing method of the non-discharge gas lamp in the third example.
Figure 15B:
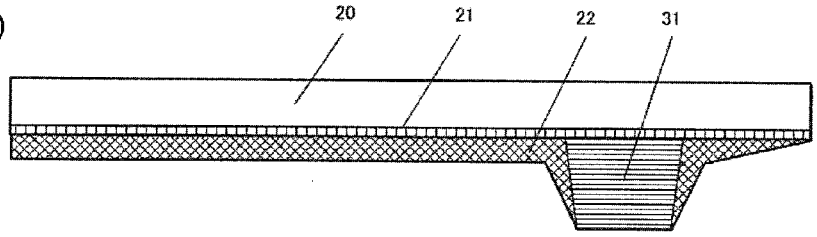
FIG. 15(B) is a sectional view taken along the line A-A' in FIG. 15(A)
Figure 16A:
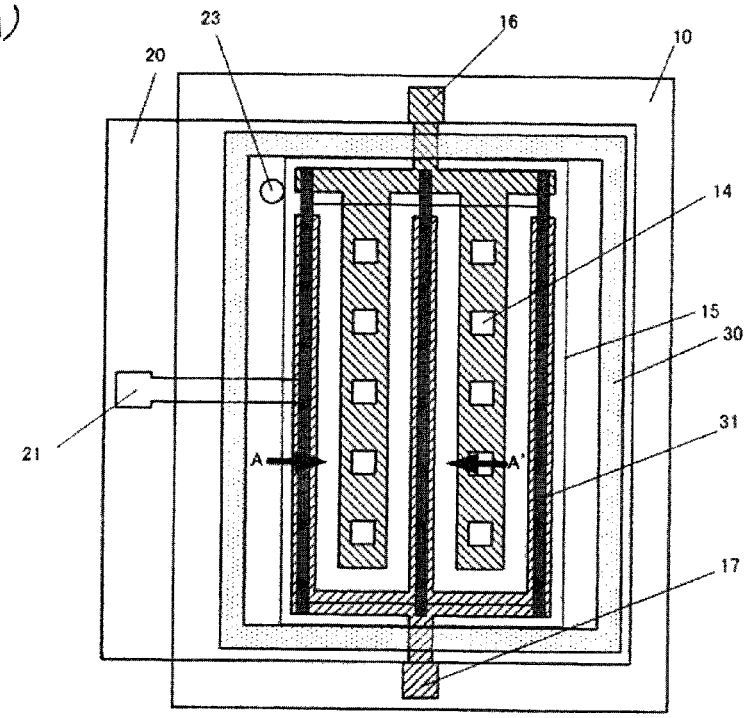
FIG. 16(A) is a view showing an example of the manufacturing method of the non-discharge gas lamp in the third example.
Figure 16B:
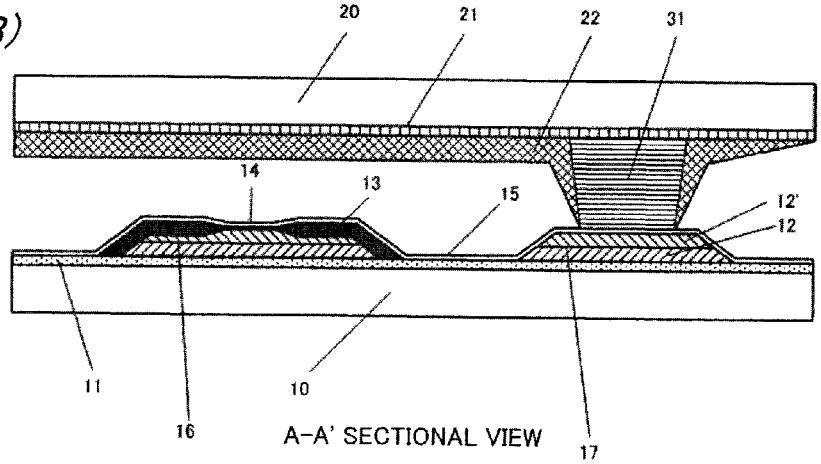
FIG. 16(B) is a sectional view taken along the line A-A' in FIG. 16(A)

The anode substrate 20 thus manufactured in FIG. 15 is combined with the cathode substrate 10 with the method of the second example to configure a lamp as shown in FIG. 16. The ribs 31 are formed along the upper electrode bus wiring 17, and a portion between the ribs (hereinafter, referred to as a rib groove) becomes an independent light-emitting region. By introducing these ribs 31, the size of the lamp can be increased while avoiding an influence of atmospheric pressure.

FOURTH EXAMPLE

In the previous third example, the ribs are introduced to the panel. As a result, a portion interposed between the ribs becomes an independent light-emitting region, and this has already been described. By using this, different types of fluorescent materials can be formed in the respective light-emitting regions separately so as to correspond to lower electrodes 16 and 16' as shown in a sectional view of FIG. 17. The types of fluorescent materials can be selected depending on a target function. For example, white light emission can be obtained when fluorescent materials for red, green, and blue colors are formed in the respective rib grooves.

Figure 17A:
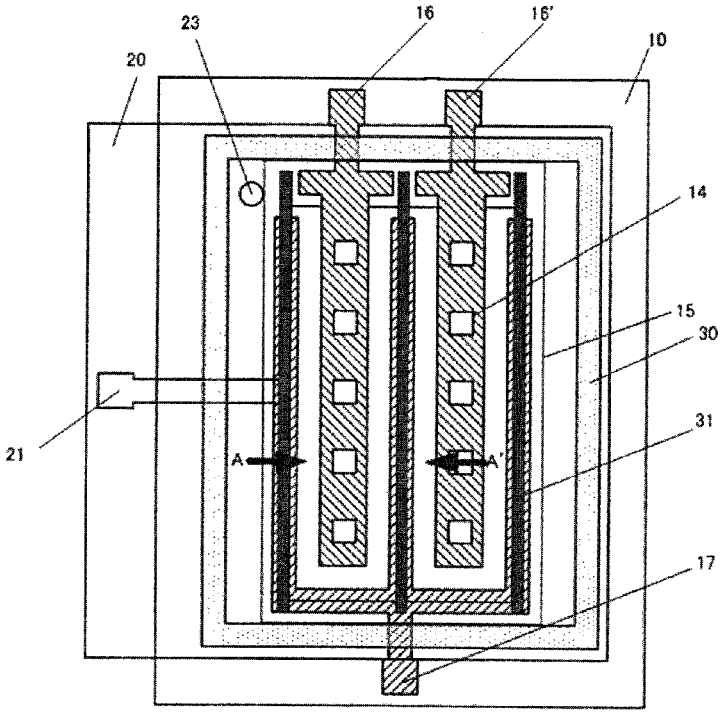
FIG. 17(A) is a view showing an example of a manufacturing method of a non-discharge gas lamp in a fourth example.
Figure 17B:
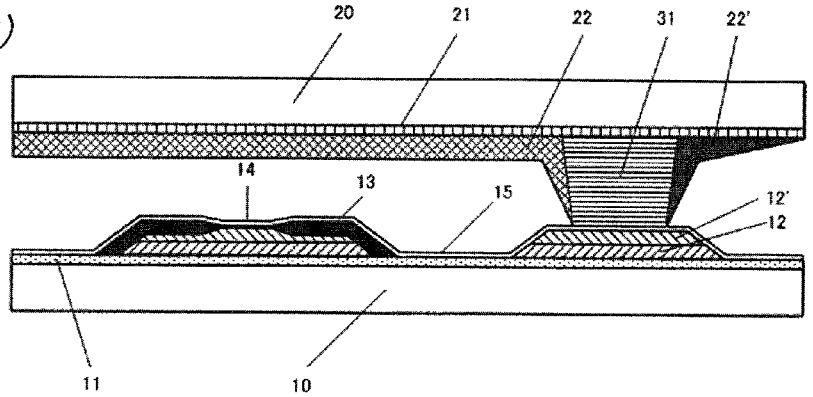
FIG. 17(B) is a sectional view taken along the line A-A' in FIG. 17(A)

If this concept is further extended, by separating the lower electrodes 16 for each rib groove and leading them out to the outside to drive them independently as shown in the top view of FIG. 17, area lighting or emission color control can also be achieved. When combined with the lighting control function described in the second example, diverse display performances for digital signage or the like can be obtained.

FIFTH EXAMPLE

If the concept of the fourth example is further extended, a non-discharge gas display apparatus can also be configured. For this purpose, a matrix array in which MIM electron sources are disposed in an X-Y plane is configured. With reference to FIGS. 18 to 26, a manufacturing method of a light-emitting cell of a matrix array plate is disclosed below.

In each drawing, (A) shows a plan view, (B) shows a sectional view taken along the line A-A' in (A), and (C) shows a sectional view taken along the line B-B' in (A).

Figure 18A:
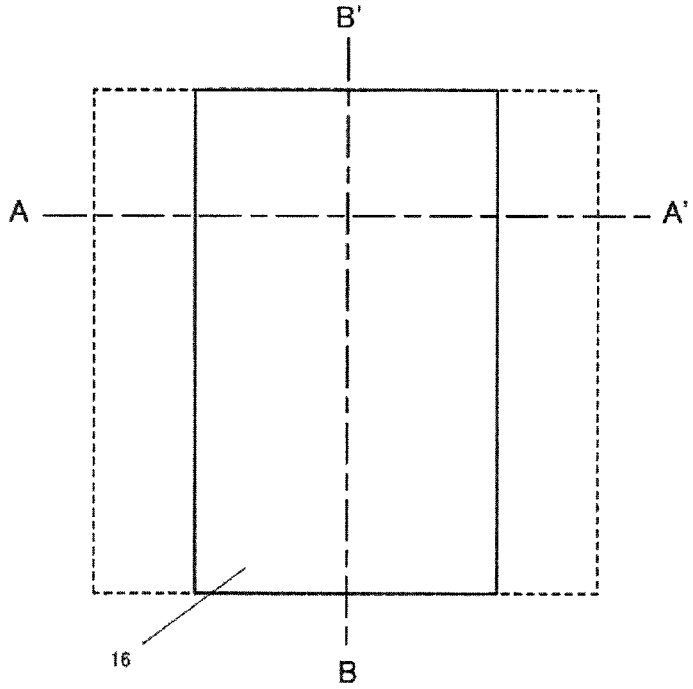
FIG. 18(A) is a view showing an example of a manufacturing method of a non-discharge gas display apparatus in a fifth example.
Figure 18B:
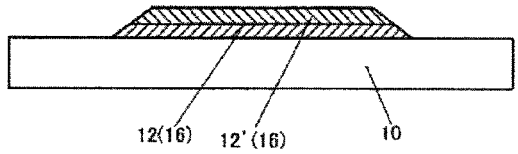
FIG. 18(B) is a sectional view taken along the line A-A' in FIG. 18(A)
Figure 18C:
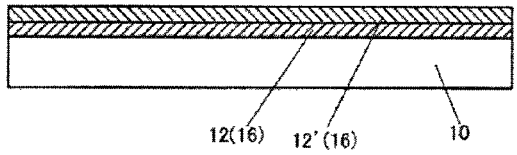
FIG. 18(C) is a sectional view taken along the line B-B' in FIG. 18(A)
Figure 19A:
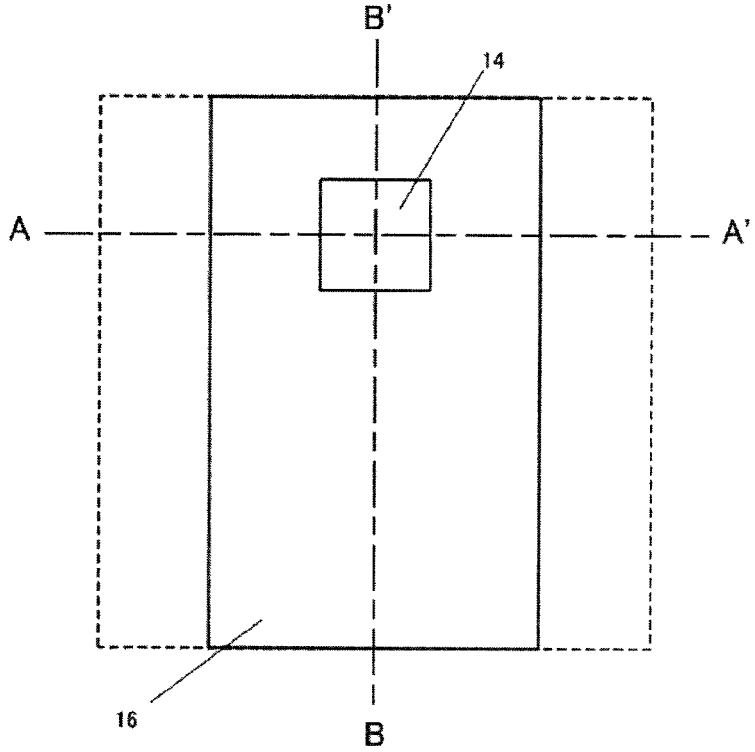
FIG. 19(A) is a view showing an example of the manufacturing method of the non-discharge gas display apparatus in the fifth example.
Figure 19B:
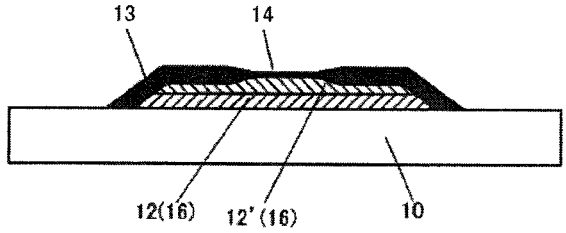
FIG. 19(B) is a sectional view taken along the line A-A' in FIG. 19(A)
Figure 19C:
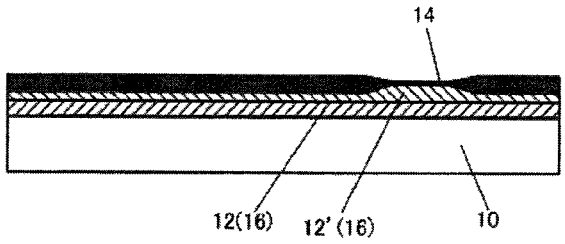
FIG. 19(C) is a sectional view taken along the line B-B' in FIG. 19(A)

On the cathode substrate 10 made of an insulator such as glass, lower electrodes 12 and 12' (identical to signal line 16') are formed in FIG. 18 and the field insulating film 13 and the tunnel insulating film 14 are formed in FIG. 19 in the same manner as that of the first example.

Figure 20A:
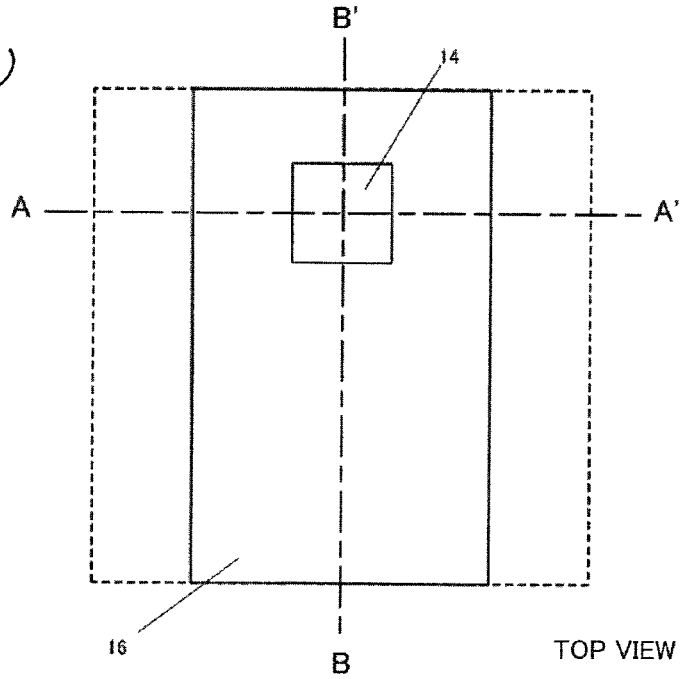
FIG. 20(A) is a view showing an example of the manufacturing method of the non-discharge gas display apparatus in the fifth example.
Figure 20B:
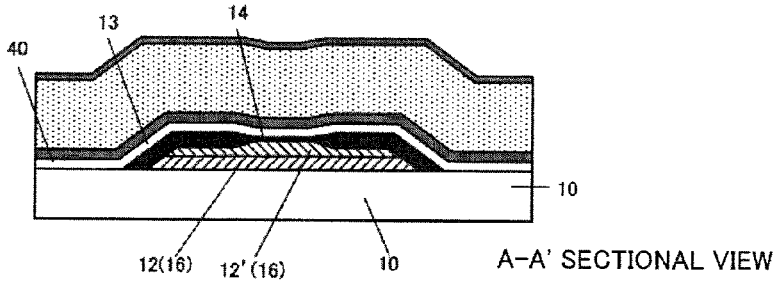
FIG. 20(B) is a sectional view taken along the line A-A' in FIG. 20(A)
Figure 20C:
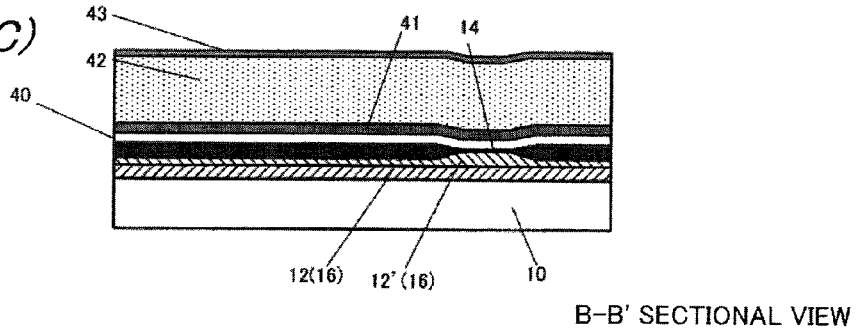
FIG. 20(C) is a sectional view taken along the line B-B' in FIG. 20(A)

In FIG. 20, as an insulating film 40, a film of silicon nitride SiN (for example, $Si_3N_4$) is formed by sputtering. Chrome (Cr) of 100 nm is formed as a connection electrode 41, an Al alloy of 2 is formed as an upper electrode bus wiring 42, and chrome (Cr) is formed thereon as a surface protective layer 43.

Figure 21A:
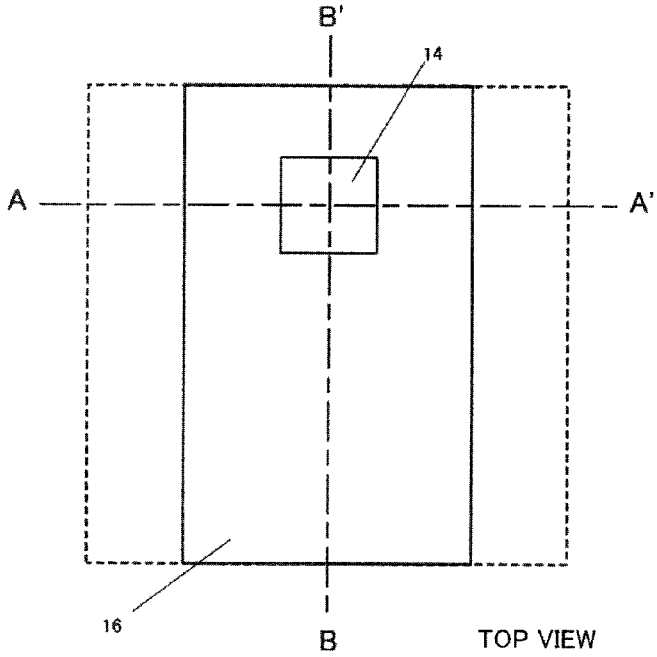
FIG. 21(A) is a view showing an example of the manufacturing method of the non-discharge gas display apparatus in the fifth example.
Figure 21B:
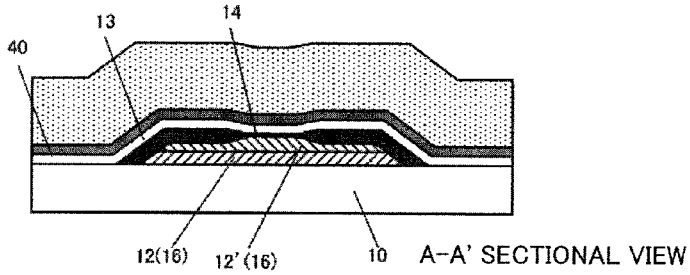
FIG. 21(B) is a sectional view taken along the line A-A' in FIG. 21(A)
Figure 21C:
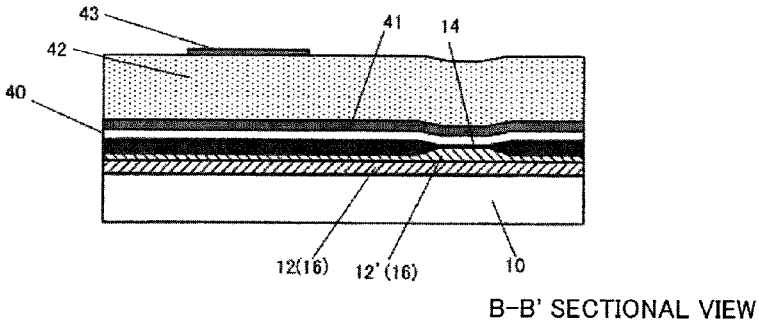
FIG. 21(C) is a sectional view taken along the line B-B' in FIG. 21(A)

In FIG. 21, Cr of the surface protective layer 43 is left in a portion to be a scanning line. For etching of Cr, a mixed aqueous solution of cerium diammonium nitrate and nitric acid is suitable. At this time, it is necessary to design the surface protective layer 43 so as to have the line width narrower than the line width of the upper electrode bus wiring 42 fabricated in the subsequent process. This is because since the upper electrode bus wiring 42 is made of an Al alloy of 2 μm, the occurrence of side-etching to approximately the same degree due to the wet etching is inevitable. If this is not taken into consideration, the surface protective layer 43 projects above from the upper electrode bus wiring 42. Since the portion projecting above from the surface protective layer 43 is insufficient in strength, easily falls and is peeled off during the manufacturing process, it causes a defect of a short circuit between scanning lines and induces a critical discharge because it causes an electric field concentration at the time of applying the anode voltage Va.

Figure 22A:
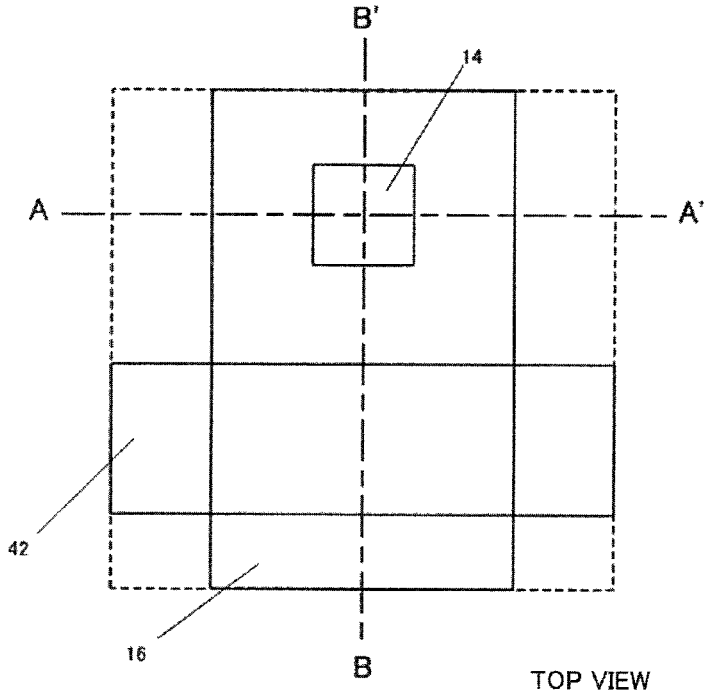
FIG. 22(A) is a view showing an example of the manufacturing method of the non-discharge gas display apparatus in the fifth example.
Figure 22B:
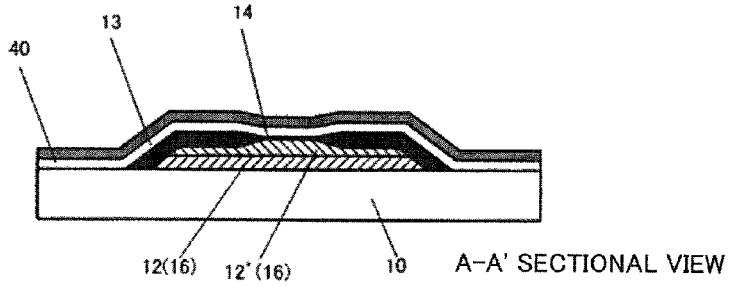
FIG. 22(B) is a sectional view taken along the line A-A' in FIG. 22(A)
Figure 22C:
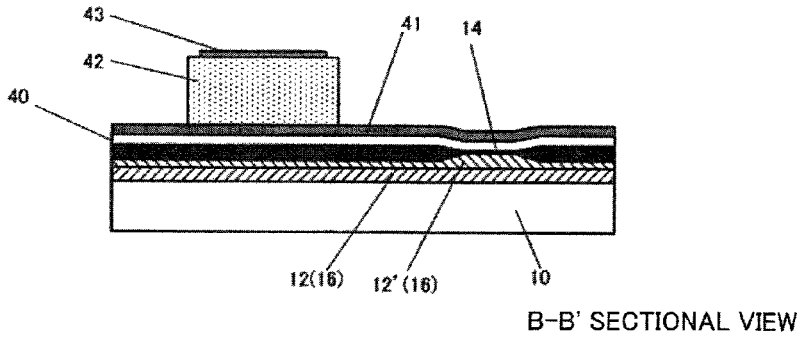
FIG. 22(C) is a sectional view taken along the line B-B' in FIG. 22(A)

In FIG. 22, the upper electrode bus wiring 42 is processed in a stripe shape in a direction orthogonal to the lower electrode 16. As an etching solution, a mixed aqueous solution of phosphoric acid, acetic acid, and nitric acid (PAN) is suitable.

Figure 23A:
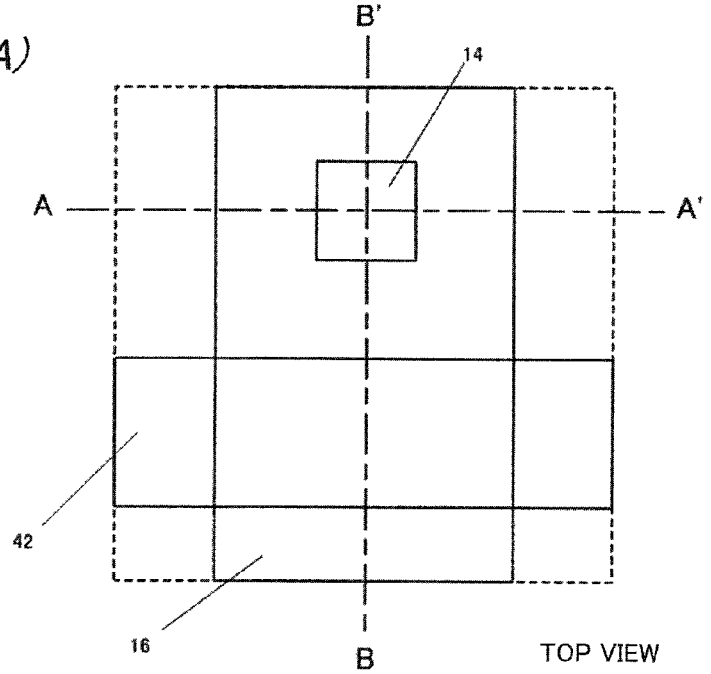
FIG. 23(A) is a view showing an example of the manufacturing method of the non-discharge gas display apparatus in the fifth example.
Figure 23B:
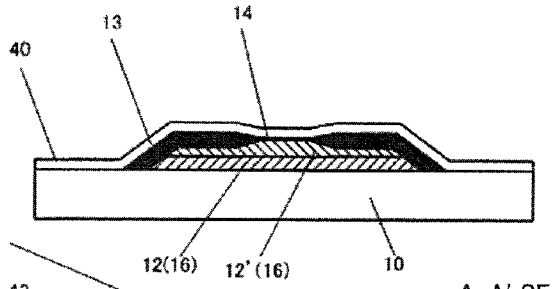
FIG. 23(B) is a sectional view taken along the line A-A' in FIG. 23(A)
Figure 23C:
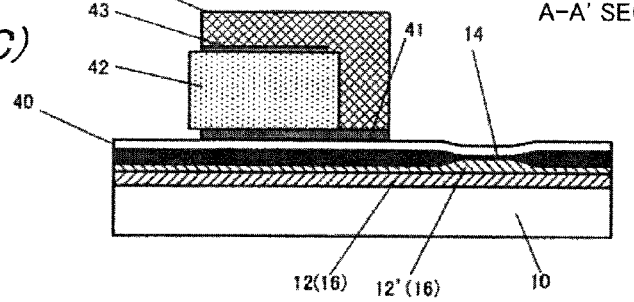
FIG. 23(C) is a sectional view taken along the line B-B' in FIG. 23(A)

In FIG. 23, the connection electrode 41 is processed so as to extend out to a tunnel insulating film 14 side and retreat with respect to the upper electrode bus wiring 42 on an opposite side (so as to form undercut). For this purpose, the wet etching is performed after a photoresist pattern 60 is placed on the connection electrode 41 in the former case and on the surface protective layer 43 in the latter case. As an etching solution, the mixed aqueous solution of cerium diammonium nitrate and nitric acid described above is suitable. At this time, the insulating film 40 plays a role of an etching stopper for protecting the tunnel insulating film 14 from the etching solution.

Figure 24A:
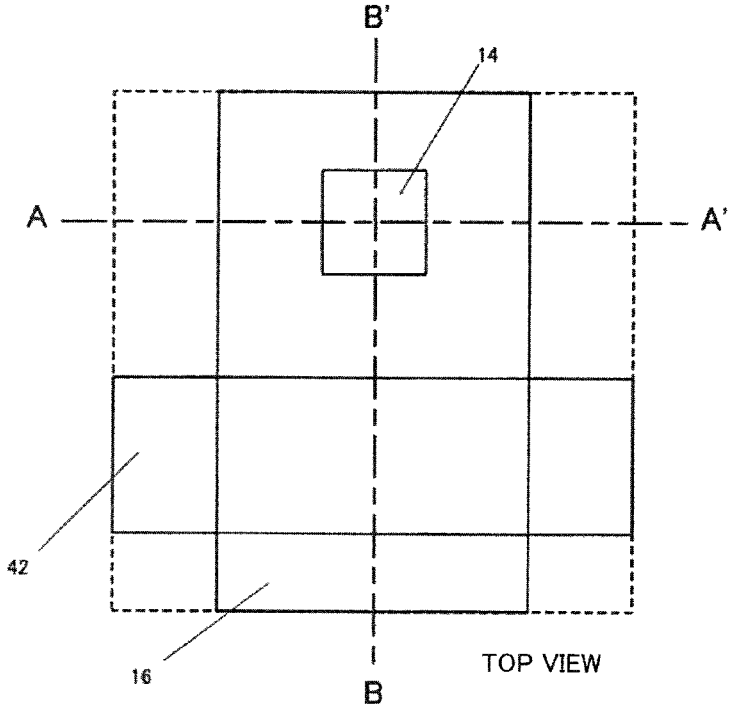
FIG. 24(A) is a view showing an example of the manufacturing method of the non-discharge gas display apparatus in the fifth example.
Figure 24B:
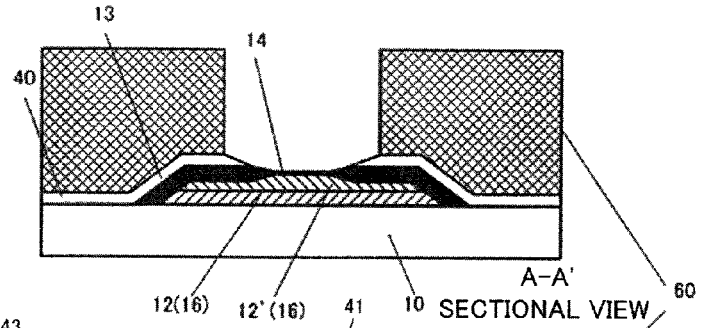
FIG. 24(B) is a sectional view taken along the line A-A' in FIG. 24(A)
Figure 24C:
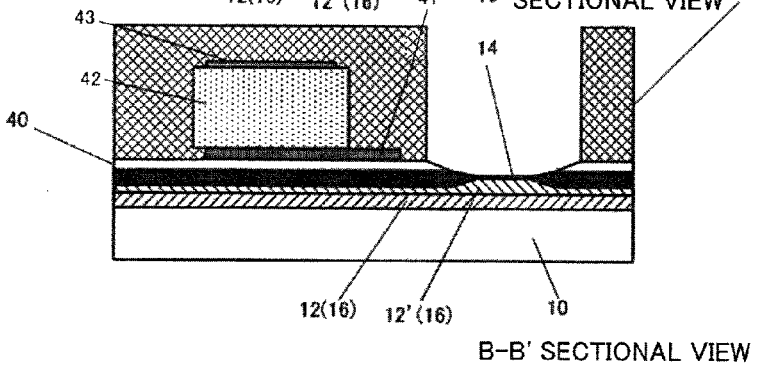
FIG. 24(C) is a sectional view taken along the line B-B' in FIG. 24(A)
Figure 25A:
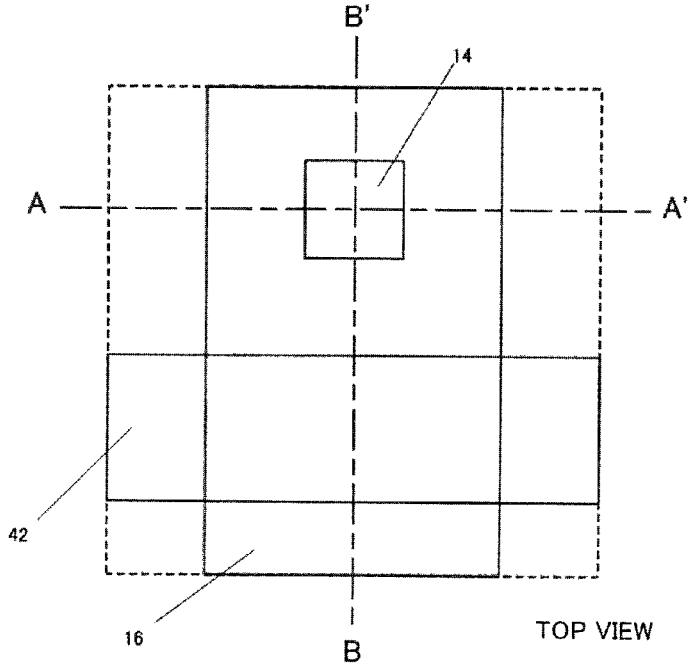
FIG. 25(A) is a view showing an example of the manufacturing method of the non-discharge gas display apparatus in the fifth example.
Figure 25B:
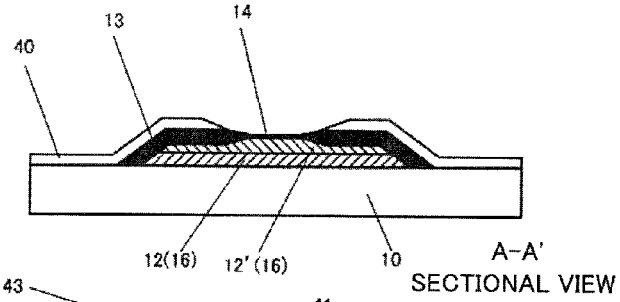
FIG. 25(B) is a sectional view taken along the line A-A' in FIG. 25(A)
Figure 25C:
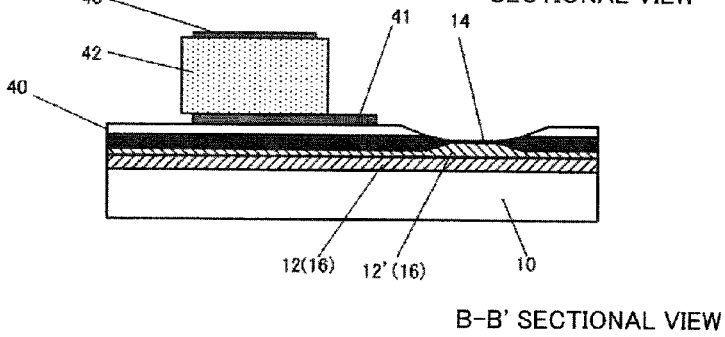
FIG. 25(C) is a sectional view taken along the line B-B' in FIG. 25(A)

In FIG. 24, in order to open an electron emission part, the photoresist pattern 60 is formed and part of the insulating film 40 is opened by photolithography and dry etching. As an etching gas, mixed gas of $CF_4$ and $O_2$ is suitable. In FIG. 25, the exposed tunnel insulating film 14 is anodized again to repair the process damage due to etching. As oxidation conditions, an electrolyte is composed of a mixed solution of ammonium tartrate aqueous solution and ethylene glycol, an oxidation current is 10 uA/cm$^2$, and an oxidation voltage is 10 V.

Figure 26A:
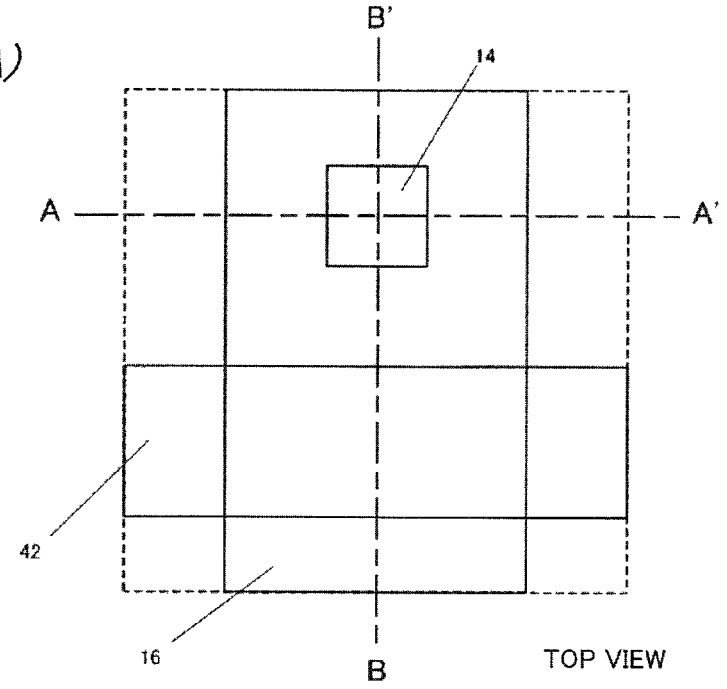
FIG. 26(A) is a view showing an example of the manufacturing method of the non-discharge gas display apparatus in the fifth example.
Figure 26B:
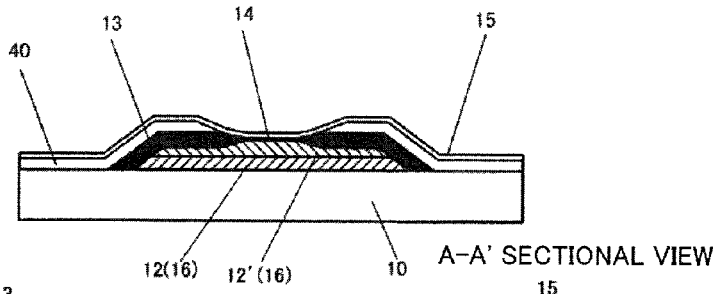
FIG. 26(B) is a sectional view taken along the line A-A' in FIG. 26(A)
Figure 26C:
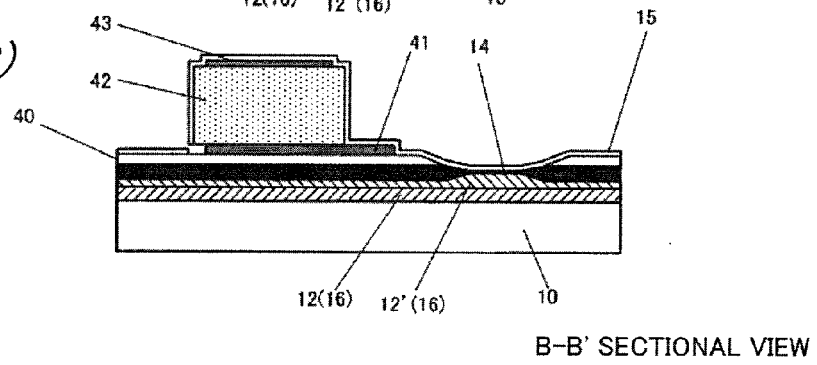
FIG. 26(C) is a sectional view taken along the line B-B' in FIG. 26(A)

After the repair oxidation is completed, the work function decreasing process described above is subsequently preformed. As shown in FIG. 26, the cathode substrate 10 (electrode source substrate or negative-pole substrate) is completed by forming the upper electrode 15. For the film formation of the upper electrode 15, sputtering (sputter) using a shadow mask is performed so that no film is formed at a terminal portion of electric wirings disposed near the substrate or other portions. The upper electrode 15 has a coating defect occurring at the undercut structure portion described above, and is automatically separated for each upper electrode bus wiring 42. Accordingly, contamination and damage of the upper electrode 15 and the tunnel insulating film 14 associated with photolithography and etching can be avoided.

Figure 27A:
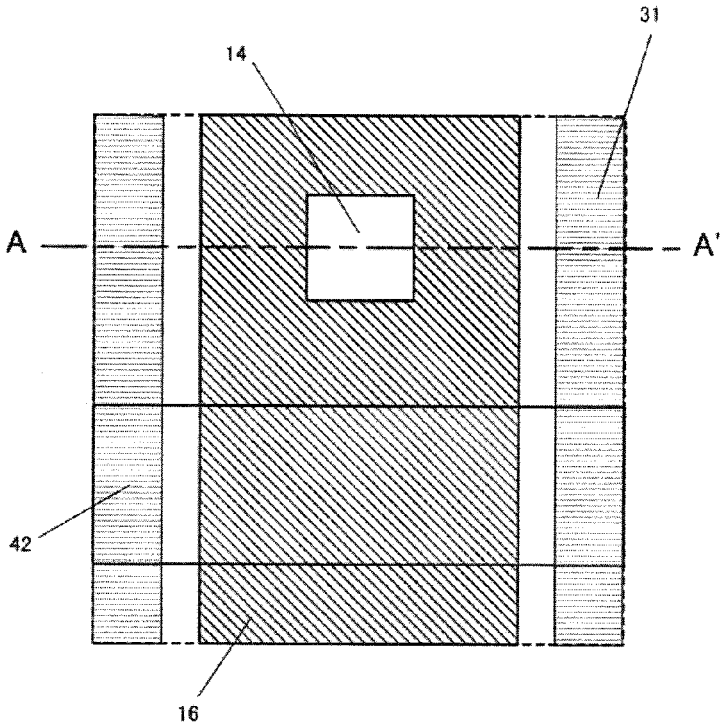
FIG. 27(A) is a view showing an example of the manufacturing method of the non-discharge gas display apparatus in the fifth example.
Figure 27B:
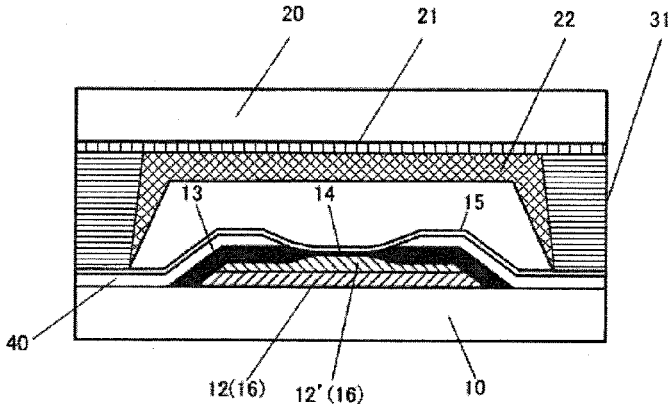
FIG. 27(B) is a sectional view taken along the line A-A' in FIG. 27(A)

In FIG. 27, after the fabricated anode substrate 20 and the completed cathode substrate 10 are sealed with a frit seal in the same manner as that of the third example, vacuum evacuation and Xe gas enclosure are performed, thereby completing the display panel. The ribs are formed in parallel to the lower electrode 16, that is, in a direction orthogonal to the upper electrode bus wiring 42. In the respective rib grooves, fluorescent materials of red color, green color, and blue color are formed in this order. As a fluorescent material, in addition to those disclosed in the first example, those for CRT and other various materials are present, and any material can be selected and used as appropriate according to the purpose and performance.

Figure 28:
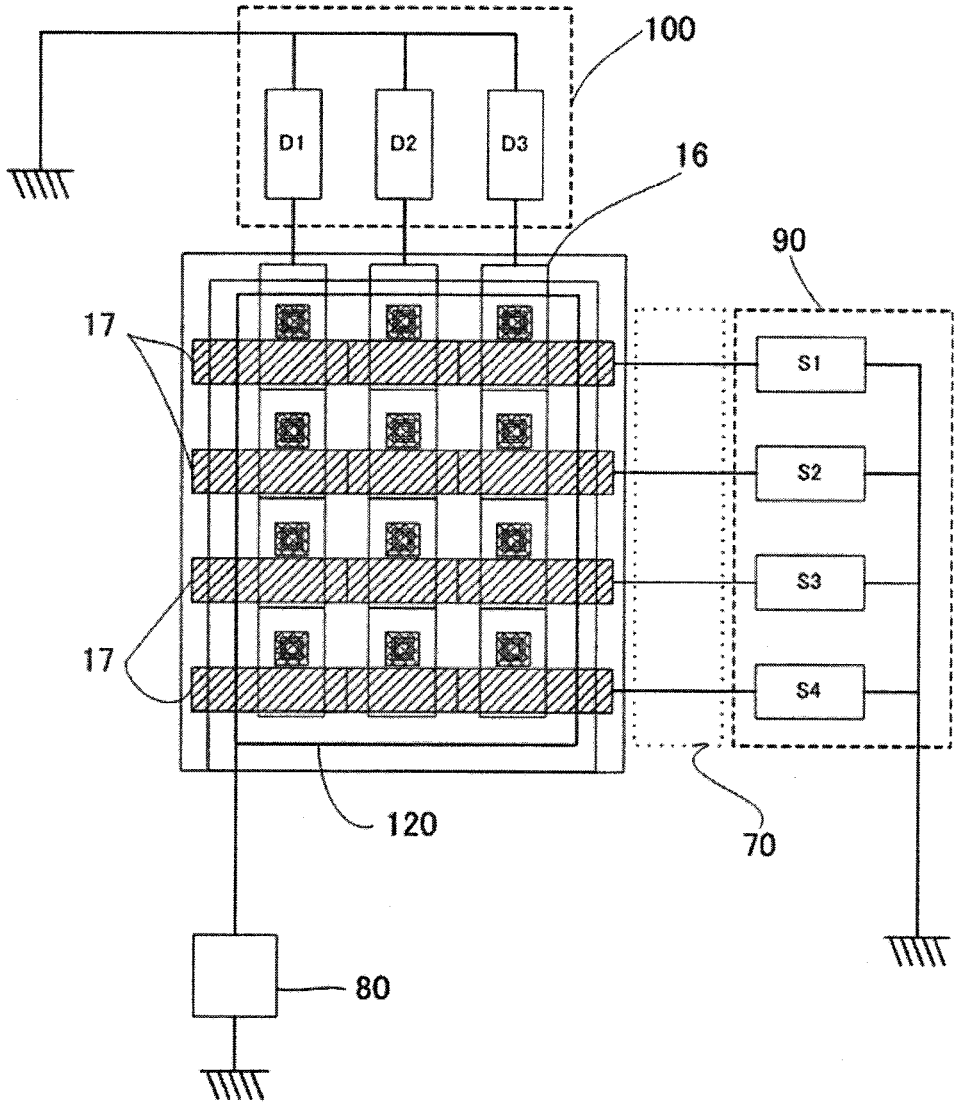
FIG. 28 is a drawing showing an example of a connection of the non-discharge gas display apparatus in the fifth example to a driving circuit.

Next, an example of structure of the display apparatus described above is described with reference to FIG. 28, and a display sequence is described with reference to FIG. 29. First, a cathode substrate in which a plurality of sub-pixels described above are disposed is fabricated. For the purpose of description, FIG. 28 shows a plan view of (3×4) sub-pixels, but in practice, a matrix with a number corresponding to the number of display dots is formed. In the drawing, a connection diagram of a display apparatus panel 120 to a driving circuit is also shown, and it shows a schematic view of an entire electric circuit which drives the display apparatus of the present invention. The lower electrode 16 provided on the cathode substrate 10 is connected as a signal line to a signal-line driving circuit 100 with an FPC 70, and the upper electrode bus wiring 42 is connected as a scanning line to a scanning-line driving circuit 90 with the FPC 70. In the signal-line driving circuit 100, signal driving circuits D corresponding to respective signal lines 16 are disposed, and in the scanning-line driving circuit 90, scanning driving circuits S corresponding to respective scanning lines 17 are disposed. A DC voltage of about 60 V is applied to the anode electrode 21 from an anode voltage generation circuit 80.

Note that it is assumed in the present example that the scanning lines and the signal lines are both driven from one side of the cathode substrate 10 as shown in FIG. 28, but to dispose respective driving circuits on both sides as required does not hinder the feasibility of the present invention at all.

Figure 29:
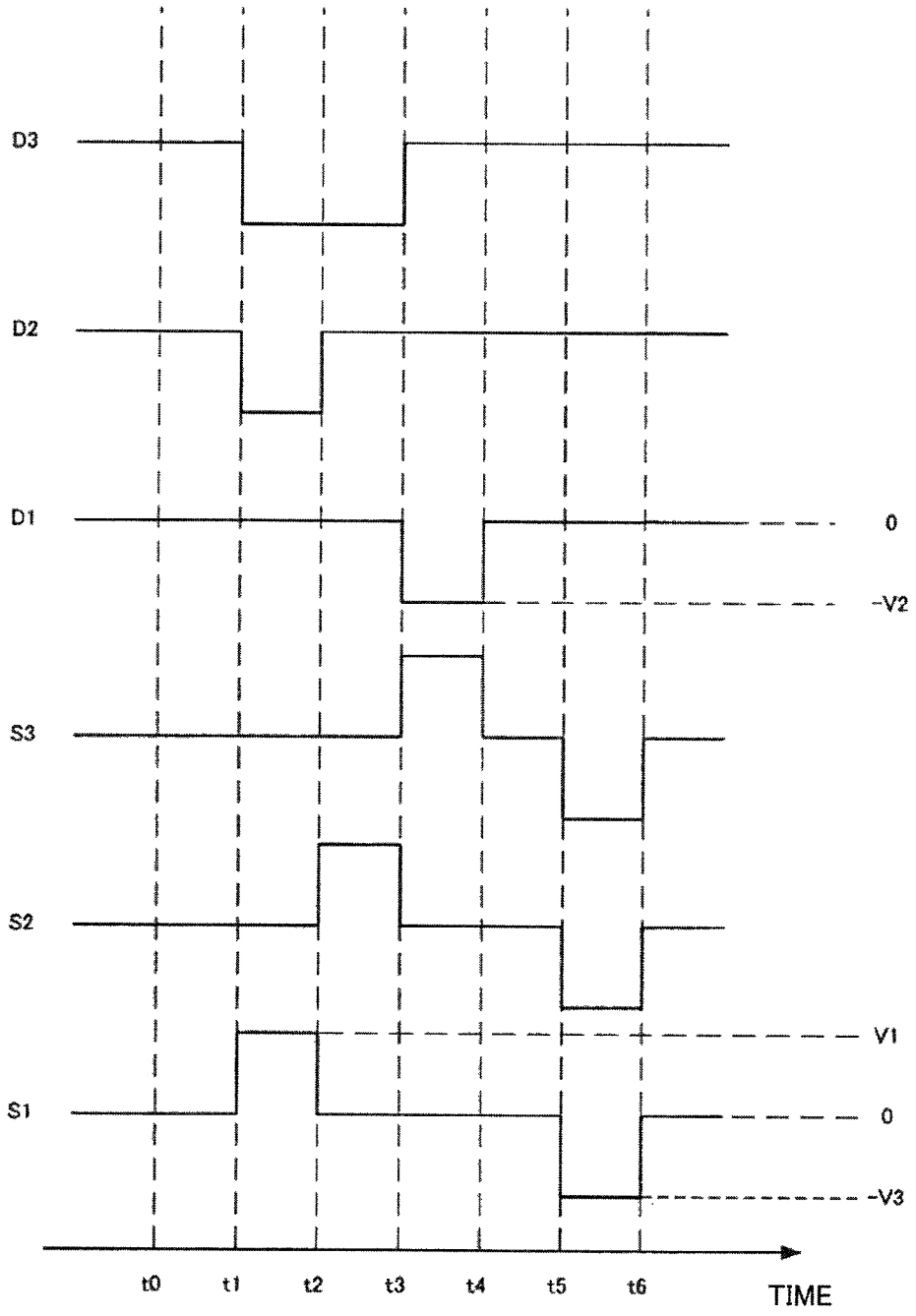
FIG. 29 is a drawing showing an example of driving waveforms of the non-discharge gas display apparatus in the fifth example.

FIG. 29 shows an example of generated voltage waveform in each driving circuit. At a time t0, all electrodes have a voltage of zero, and therefore no electron is emitted, and the fluorescent material does not emit light. At a time t1, a voltage of V1 is applied to only S1 of the upper electrode bus wiring 42, and a voltage of −V2 is applied to D2 and D3 of the lower electrode 16. At coordinates (1, 2) and (1, 3), a voltage of (V1+V2) is applied between the lower electrode 16 and the upper electrode bus wiring 42. Thus, if (V1+V2) is set to be equal to or higher than an electron emission starting voltage, electrons are emitted from these MIM-type electron sources into gas. The emitted electrons are eventually collected by the voltage generation circuit 80 to the anode electrode 21. Similarly, when a voltage of V1 is applied to S2 of the upper electrode bus wiring 42 and a voltage of −V2 is applied to D3 of the lower electrode 16 at a time t2, coordinates (2, 3) is similarly lit up, electrons are emitted, and a fluorescent material on the electron source coordinates emits light.

By changing a scanning signal to be applied to the upper electrode bus wiring 42 in this manner, a desired image or information can be displayed. Also, by changing the magnitude of the applied voltage −V2 to the lower electrode 16, a gray-scale image can be displayed. The display method described above is generally called a line-sequential display method. At a time t5, a turnover voltage for releasing the electric charges accumulated in the tunnel insulating film 14 is applied. More specifically, −V3 is applied to all of the upper electrode bus wirings 42, and at the same time, 0 V is applied to the lower electrode 16.

As for the display performance, some values in the column "D" in FIG. 30 have to be corrected. First, the luminance is decreased because a lighting time of each sub-pixel is restricted to be shorter than that in the case of illumination. More specifically, when a display format is assumed to be full HD with horizontal 1920×vertical 1080 pixels, one frame time is 1/60 second in interlace display. Accordingly, a selection time of one scanning line is 1/60×1/540, that is, 30.8 usec. This is approximately equal to that of FIG. 30 in pulse width, but when the fact that the repetition frequency is tenfold, that is, 600 Hz in FIG. 30 is taken into consideration, the luminance obtained is supposed to be decreased to 1/10. In addition, in order to prevent a decrease in contrast due to reflections of external light in the display apparatus, a dedicated area of the fluorescent material is required to be restricted to approximately 1/3 of the display area.

In consideration of the above two points, the performance of the non-discharge gas display apparatus according to the present invention can be expected to have a peak luminance of 1780 [cd/m$^2$], an average luminance (peak luminance×1/4) of 445 [cd/m$^2$], and a white luminous efficiency of 51 [lm/W]. These values are higher numerical values compared with those of current LCDs and PDPs, which indicates that the non-discharge gas display apparatus of the present invention has an extremely high performance.

DESCRIPTION OF REFERENCE NUMERALS

10 . . . cathode substrate
11 . . . alkali diffusion preventive film
12 . . . lower electrode
13 . . . field insulating film
14 . . . tunnel insulating layer
15 . . . upper electrode
16 . . . lower electrode
17, 42 . . . upper electrode bus wiring
20 . . . anode substrate
21 . . . anode electrode
22 . . . fluorescent material film
23 . . . through hole
30 . . . frit seal
31 . . . rib
40 . . . insulating film
41 . . . connection electrode
43 . . . surface protective layer
50 . . . vacuum container
51 . . . quartz glass window
60 . . . photoresist pattern
70 . . . FPC
80 . . . anode voltage generation circuit
90 . . . scanning-line driving circuit
100 . . . signal-line driving circuit
120 . . . display apparatus panel

The invention claimed is:

1. A fluorescent lamp comprising: a front substrate and a back substrate facing each other; a container configured of walls surrounding the front substrate and the back substrate; an electron source placed on a front substrate side of the back substrate and emitting hot electrons; a fluorescent material placed on a back substrate side of the front substrate, absorbing ultraviolet rays, and performing visible light emission; a noble gas or a molecular gas enclosed in the container; and electrodes provided on the front substrate and the back substrate, wherein the hot electrons emitted into the noble gas or the molecular gas are collected by applying an anode voltage between the electrodes, and a current luminous efficiency obtained by dividing a luminance L of the visible light emission by an anode current density is proportional to a value of an anode electric field obtained by dividing the anode voltage by a substrate distance between the front substrate and the back substrate, wherein the noble gas or the molecular gas has a pressure equal to or higher than 10 kPa, the anode voltage is equal to or lower than 240 V, and the substrate distance is equal to or smaller than 0.4 mm.

2. The fluorescent lamp according to claim 1,
wherein the noble gas or the molecular gas has a pressure equal to or higher than 30 kPa.

3. The fluorescent lamp according to claim 1,
wherein the noble gas or the molecular gas has a pressure equal to or higher than 60 kPa.

4. A fluorescent lamp comprising: a front substrate and a back substrate facing each other; a container configured of walls surrounding the front substrate and the back substrate; an electron source placed on a front substrate side of the back substrate and emitting hot electrons; a fluorescent material placed on a back substrate side of the front substrate, absorbing ultraviolet rays, and performing visible light emission; a noble gas or a molecular gas enclosed in the container; and electrodes provided on the front substrate and the back substrate, wherein the hot electrons emitted into the noble gas or the molecular gas are collected by applying an anode voltage between the electrodes, the gas has a pressure equal to or higher than 10 kPa, the anode voltage is equal to or lower than 240 V, and a substrate distance is equal to or smaller than 0.4 mm.

5. The fluorescent lamp according to claim 4,
wherein the noble gas or the molecular gas has a pressure equal to or higher than 30 kPa.

6. The fluorescent lamp according to claim 4,
wherein the noble gas or the molecular gas has a pressure equal to or higher than 60 kPa.

7. The fluorescent lamp according to claim 1,
wherein the electron source is an MIM-type electron source obtained by stacking a lower electrode, an electron accelerating layer, and an upper electrode in this order, the lower electrode of the MIM-type electron source is made of an Al alloy to which one or a plurality of a 3A group metal, a 4A group metal, and a 5A group metal in a periodic table are added, the electron accelerating layer of the MIM-type electron source is a tunnel insulating film formed of an anodic oxide film of the Al alloy, and the upper electrode of the MIM-type electron source is a thin film obtained by stacking Ir, Pt, and Au in this order.

8. The fluorescent lamp according to claim 7, wherein on a surface side of the Al alloy, a content of an alloy additive material is equal to or smaller than 1 atom %, the tunnel insulating film is an anodic oxide film by an oxidation voltage equal to or higher than 6 V and has a surface modified by an alkali metal oxide, and electron emission efficiency exceeds 5%.

9. The fluorescent lamp according to claim 1, wherein ribs are provided on the back substrate side of the front substrate.

10. An image display apparatus comprising: a display apparatus panel; a voltage generation circuit; and a signal-line driving circuit, the display apparatus panel being a fluorescent lamp including: a front substrate and a back substrate facing each other; a container configured of walls surrounding the front substrate and the back substrate; a plurality of electron sources one-dimensionally or two-dimensionally arranged on a front substrate side of the back substrate and emitting hot electrons; a plurality of fluorescent materials one-dimensionally or two-dimensionally arranged, placed on a back substrate side of the front substrate so as to correspond to respective electron sources of the plurality of electron sources, absorbing ultraviolet rays, and performing visible light emission; a noble gas or a molecular gas enclosed in the container; and electrodes provided on the front substrate and the back substrate, wherein the hot electrons emitted into the noble gas or the molecular gas are collected by applying an anode voltage between the electrodes, and a current luminous efficiency obtained by dividing a luminance L of the visible light emission by an anode current density is proportional to a value of an anode electric field obtained by dividing the anode voltage by a substrate distance between the front substrate and the back substrate, wherein the noble gas or the molecular gas has a pressure equal to or higher than 10 kPa, the anode voltage is equal to or lower than 240 V, and the substrate distance is equal to or smaller than 0.4 mm.

11. The image display apparatus according to claim 10, wherein the noble gas or the molecular gas has a pressure equal to or higher than 30 kPa.

12. The image display apparatus according to claim 10, wherein the noble gas or the molecular gas has a pressure equal to or higher than 60 kPa.

13. An image display apparatus comprising: a display apparatus panel; a voltage generation circuit; and a signal-line driving circuit, the display apparatus panel including: a front substrate and a back substrate facing each other; a container configured of walls surrounding the front substrate and the back substrate; a plurality of electron sources one-dimensionally or two-dimensionally arranged on a front substrate side of the back substrate and emitting hot electrons; a plurality of fluorescent materials one-dimensionally or two-dimensionally arranged, placed on a back substrate side of the front substrate so as to correspond to respective electron sources of the plurality of electron sources, absorbing ultraviolet rays, and performing visible light emission; a noble gas or a molecular gas enclosed in the container; and electrodes placed on the front substrate and the back substrate, wherein the hot electrons emitted into the noble gas or the molecular gas are collected by applying an anode voltage between the electrodes, the gas has a pressure equal to or higher than 10 kPa, the anode voltage is equal to or lower than 240 V, and the substrate distance is equal to or smaller than 0.4 mm.

14. The image display apparatus according to claim 10, wherein the plurality of electron sources are MIM-type electron sources each obtained by stacking a lower electrode, an electron accelerating layer, and an upper electrode in this order, the lower electrode of the MIM-type electron source is made of an Al alloy to which one or a plurality of a 3A group metal, a 4A group metal, and a 5A group metal in a periodic table are added, the electron accelerating layer of the MIM-type electron source is a tunnel insulating film formed of an anodic oxide film of the Al alloy, and the upper electrode of the MIM-type electron source is a thin film obtained by stacking Ir, Pt, and Au in this order.

15. The image display apparatus according to claim 14, wherein on a surface side of the Al alloy, a content of an alloy additive material is equal to or smaller than 1 atom%, the tunnel insulating film is an anodic oxide film by an oxidation voltage equal to or higher than 6 V and has a surface modified by an alkali metal oxide, and electron emission efficiency exceeds 5%.

16. The image display apparatus according to claim 10, further comprising: a surface protective layer; and an upper electrode feeder line, wherein the surface protective layer has a line width narrower than a line width of the upper electrode feeder line.

* * * * *